US006326980B1

(12) United States Patent
Worley, III

(10) Patent No.: US 6,326,980 B1
(45) Date of Patent: Dec. 4, 2001

(54) SYSTEM AND METHOD FOR USING COMPOUND DATA WORDS IN A FIELD SEQUENTIAL DISPLAY DRIVING SCHEME

(75) Inventor: W. Spencer Worley, III, Half Moon Bay, CA (US)

(73) Assignee: Aurora Systems, Inc., San Jose, CA (US)

( * ) Notice: Subject to any disclaimer, the term of this patent is extended or adjusted under 35 U.S.C. 154(b) by 0 days.

(21) Appl. No.: 09/484,739

(22) Filed: Jan. 18, 2000

Related U.S. Application Data

(63) Continuation-in-part of application No. 09/032,174, filed on Feb. 27, 1998, now Pat. No. 6,151,011.

(51) Int. Cl.[7] ..... G09G 5/10
(52) U.S. Cl. ..... 345/691; 345/692
(58) Field of Search ..... 345/147, 148, 345/87, 89, 94, 99, 204, 208, 690–693

(56) References Cited

U.S. PATENT DOCUMENTS 5,497,172 * 3/1996 Doherty et al. ..... 345/148
5,619,228 * 4/1997 Doherty ..... 345/148
5,731,802 * 3/1998 Aras et al. ..... 345/148
5,969,710 * 10/1999 Doherty et al. ..... 345/147
5,986,640 * 11/1999 Baldwin et al. ..... 345/147
6,100,939 * 8/2000 Kougami et al. ..... 345/148
6,151,011 * 11/2000 Worley, III et al. ..... 345/147

* cited by examiner

*Primary Examiner*—Regina Liang
(74) *Attorney, Agent, or Firm*—Henneman & Saunders; Larry E. Henneman, Jr.

(57) ABSTRACT

A system and method for asserting compound data words on a display pixel according to a field sequential driving scheme is disclosed. In a particular embodiment, a display driver circuit includes an output controller for generating control signals to sequentially assert a first portion of a first compound data word on the display pixel, assert a first portion of a second compound data word on the display pixel, assert a second portion of the first compound data on the display pixel, and assert a second portion of the second compound data word on the display pixel. A particular display driver circuit includes a compound data generator which generates the compound data words from data words of a first type. The first portions of the compound data words are generated from the first type data words according to one predefined mapping scheme, and the second portions are generated according to another predefined mapping scheme.

40 Claims, 21 Drawing Sheets

| Gray Scale Values | Bits B7-B0 | Out of Phase |
|---|---|---|
| 000 | 0000 0000 | |
| . | . | |
| 015 | 0000 1111 | |
| 016 | 0001 0000 | 31/255 |
| . | . | |
| 031 | 0001 1111 | |
| 032 | 0010 0000 | 63/255 |
| . | . | |
| 047 | 0010 1111 | |
| 048 | 0011 0000 | 31/255 |
| . | . | |
| 063 | 0011 1111 | |
| 064 | 0100 0000 | 127/255 |
| . | . | |
| 079 | 0100 1111 | |
| 080 | 0101 0000 | 31/255 |
| . | . | |
| 095 | 0101 1111 | |
| 096 | 0110 0000 | 63/255 |
| . | . | |
| 111 | 0110 1111 | |
| 112 | 0111 0000 | 31/255 |
| . | . | |
| 127 | 0111 1111 | |
| 128 | 1000 0000 | 255/255 |
| . | . | |

| Gray Scale Values | Bits B7-B0 | Out of Phase |
|---|---|---|
| 143 | 1000 1111 | |
| 144 | 1001 0000 | 31/255 |
| . | . | |
| 159 | 1001 1111 | |
| 160 | 1010 0000 | 63/255 |
| . | . | |
| 175 | 1010 1111 | |
| 176 | 1011 0000 | 31/255 |
| . | . | |
| 191 | 1011 1111 | |
| 192 | 1100 0000 | 127/255 |
| . | | |
| 207 | 1100 1111 | |
| 208 | 1101 0000 | 31/255 |
| . | . | |
| 223 | 1101 1111 | |
| 224 | 1110 0000 | 63/255 |
| . | . | |
| 239 | 1110 1111 | |
| 240 | 1111 0000 | 31/255 |
| . | . | |
| 255 | 1111 1111 | |

FIG. 4
Prior Art

FIG. 6A

| Gray Scale Values | B8'-B6:B5-B0 | Out of Phase |
|---|---|---|
| 000 | 000 000000 | |
| . | . | |
| 063 | 000 111111 | 127/255 |
| 064 | 001 000000 | |
| . | . | |
| 127 | 001 111111 | 127/255 |
| 128 | 011 000000 | |
| . | . | |
| 191 | 011 111111 | 127/255 |
| 192 | 111 000000 | |
| . | . | |
| 255 | 111 111111 | |

FIG. 6B

| Gray Scale Values | B11'-B5: B4-B0 | Out of Phase |
|---|---|---|
| 000 | 0000000 00000 | |
| . | . | |
| 031 | 0000000 11111 | |
| 032 | 0000001 00000 | 63/255 |
| . | . | |
| 063 | 0000001 11111 | |
| 064 | 0000011 00000 | 63/255 |
| . | . | |
| 095 | 0000011 11111 | |
| 096 | 0000111 00000 | 63/255 |
| . | | |
| 127 | 0000111 11111 | |
| 128 | 0001111 00000 | 63/255 |
| . | . | |
| 159 | 0001111 11111 | |
| 160 | 0011111 00000 | 63/255 |
| . | . | |
| 191 | 0011111 11111 | |
| 192 | 0111111 00000 | 63/255 |
| . | . | |
| 223 | 0111111 11111 | |
| 224 | 1111111 00000 | 63/255 |
| . | . | |
| 255 | 1111111 11111 | |

| Gray Scale Values | B9-B4:B3-B0 | Out of Phase |
|---|---|---|
| 000 | 000000 0000 | |
| . | . | |
| 015 | 000000 1111 | |
| 016 | 000001 0000 | 31/111 |
| . | . | |
| 031 | 000001 1111 | |
| 032 | 000011 0000 | 31/111 |
| . | . | |
| 047 | 000011 1111 | |
| 048 | 000111 0000 | 31/111 |
| . | . | |
| 063 | 000111 1111 | |
| 064 | 001111 0000 | 31/111 |
| . | . | |
| 079 | 001111 1111 | |
| 080 | 011111 0000 | 31/111 |
| . | . | |
| 095 | 011111 1111 | |
| 096 | 111111 0000 | 31/111 |
| . | . | |
| 111 | 111111 1111 | |

FIG. 7

| Total Bits | E.W. Bits | B.W. Bits | # Gray Levels | Max. Phase Difference | Approx. Difference |
|---|---|---|---|---|---|
| 8 | 6 | 2 | 28 | 7/27 | 0.259 |
| | 5 | 3 | 48 | 15/47 | 0.319 |
| | 4 | 4 | 80 | 31/79 | 0.392 |
| | 3 | 5 | 128 | 63/127 | 0.496 |
| 9 | 7 | 2 | 32 | 7/31 | 0.226 |
| | 6 | 3 | 56 | 15/55 | 0.273 |
| | 5 | 4 | 96 | 31/95 | 0.326 |
| | 4 | 5 | 160 | 63/159 | 0.396 |
| 10 | 8 | 2 | 36 | 7/35 | 0.200 |
| | 7 | 3 | 64 | 15/63 | 0.238 |
| | 6 | 4 | 112 | 31/111 | 0.279 |
| | 5 | 5 | 192 | 63/191 | 0.330 |

FIG. 8

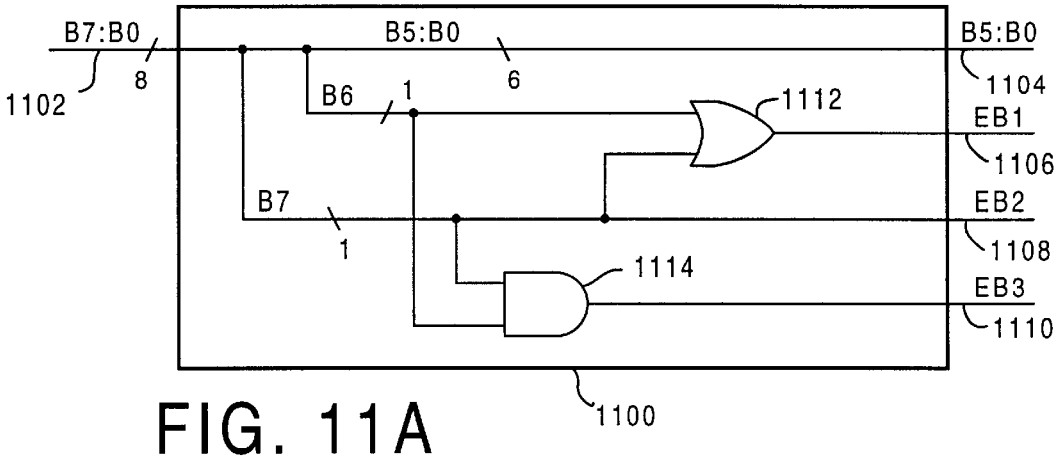
FIG. 11A
FIG. 11B
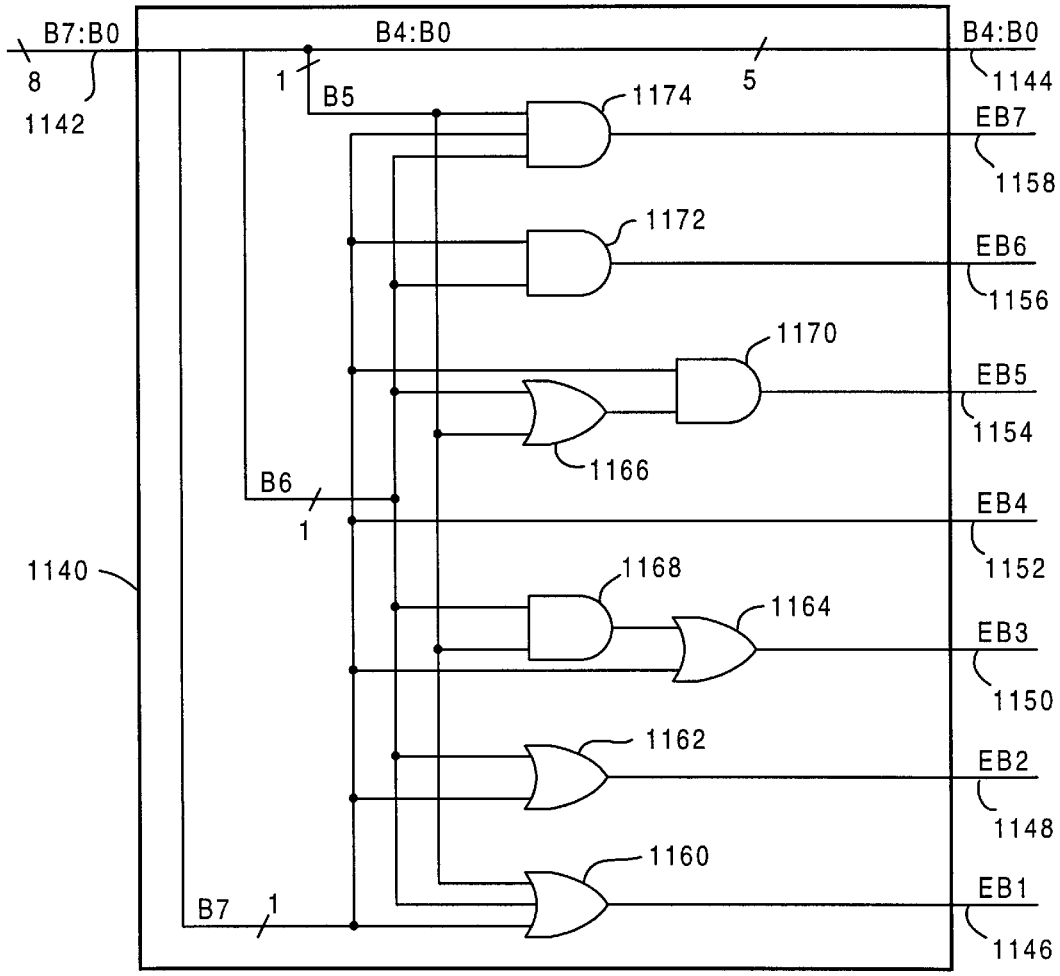

SYSTEM AND METHOD FOR USING COMPOUND DATA WORDS IN A FIELD SEQUENTIAL DISPLAY DRIVING SCHEME

RELATED APPLICATIONS

This application is a continuation-in-part of U.S. patent application Ser. No. 09/032,174, filed Feb. 27, 1998, now U.S. Pat. No. 6,151,011, entitled "SYSTEM AND METHOD FOR USING COMPOUND DATA WORDS TO REDUCE THE DATA PHASE DIFFERENCE BETWEEN ADJACENT PIXEL ELECTRODES," which has a common inventor herewith, and which is incorporated herein by reference in its entirety.

BACKGROUND OF THE INVENTION

1. Field of the Invention

This invention relates generally to electronic driver circuits, and more particularly to a novel circuit and method for using compound data words to drive a display.

2. Description of the Background Art

FIG. 1 shows a single pixel cell 100 of a typical liquid crystal display. Pixel cell 100 includes a liquid crystal layer 102, contained between a transparent common electrode 104 and a pixel storage electrode 106, and a storage element 108. Storage element 108 includes complementary data input terminals 110 and 112, data output terminal 114, and a control terminal 116. Responsive to a write signal on control terminal 116, storage element 108 reads complementary data signals asserted on a pair of bit lines (B+ and B−) 118 and 120, and latches the signal on output terminal 114 and coupled pixel electrode 106.

Liquid crystal layer 102 rotates the polarization of light passing through it, the degree of rotation depending on the root-mean-square (RMS) voltage across liquid crystal layer 102. The ability to rotate the polarization is exploited to modulate the intensity of reflected light as follows. An incident light beam 122 is polarized by polarizer 124. The polarized beam then passes through liquid crystal layer 102, is reflected off of pixel electrode 106, and passes again through liquid crystal layer 102. During this double pass through liquid crystal layer 102, the beam's polarization is rotated by an amount which depends on the data signal being asserted on pixel storage electrode 106. The beam then passes through polarizer 126, which passes only that portion of the beam having a specified polarity. Thus, the intensity of the reflected beam passing through polarizer 126 depends on the amount of polarization rotation induced by liquid crystal layer 102, which in turn depends on the data signal being asserted on pixel storage electrode 106.

Storage element 108 can be either an analog storage element (e.g. capacitative) or a digital storage element (e.g., SRAM latch). In the case of a digital storage element, a common way to drive pixel storage electrode 106 is via pulse-width-modulation (PWM). In PWM, different gray scale levels are represented by multi-bit words (i.e., binary numbers). The multi-bit words are converted to a series of pulses, whose time-averaged root-mean-square (RMS) voltage corresponds to the analog voltage necessary to attain the desired gray scale value.

For example, in a 4-bit PWM scheme, the frame time (time in which a gray scale value is written to every pixel) is divided into 15 time intervals. During each interval, a signal (high, e.g., 5V or low, e.g., 0V) is asserted on the pixel storage electrode 106. There are, therefore, 16 (0–15) different gray scale values possible, depending on the number of "high" pulses asserted during the frame time. The assertion of 0 high pulses corresponds to a gray scale value of 0 (RMS 0V), whereas the assertion of 15 high pulses corresponds to a gray scale value of 15 (RMS 5V). Intermediate numbers of high pulses correspond to intermediate gray scale levels.

FIG. 2 shows a series of pulses corresponding to the 4-bit gray scale value (1010), where the most significant bit is the far left bit. In this example of binary-weighted pulse-width modulation, the pulses are grouped to correspond to the bits of the binary gray scale value. Specifically, the first group B3 includes 8 intervals ($2^3$), and corresponds to the most significant bit of the value (1010). Similarly, group B2 includes 4 intervals ($2^2$) corresponding to the next most significant bit, group B1 includes 2 intervals ($2^1$) corresponding to the next most significant bit, and group B0 includes 1 interval ($2^0$) corresponding to the least significant bit. This grouping reduces the number of pulses required from 15 to 4, one for each bit of the binary gray scale value, with the width of each pulse corresponding to the significance of its associated bit. Thus, for the value (1010), the first pulse B3 (8 intervals wide) is high, the second pulse B2 (4 intervals wide) is low), the third pulse B1 (2 intervals wide) is high, and the last pulse B0 (1 interval wide) is low. This series of pulses results in an RMS voltage that is approximately $$\sqrt{\frac{2}{3}}$$

(10 of 15 intervals) of the full value (5V), or approximately 4.1V.

FIG. 3 shows 3 pixel cells 100(*a–c*) arranged adjacent one another, as in a typical flat panel display. Problems arise in such displays, because differing signals on adjacent pixel cells can cause visible artifacts in a display image. For example, electrical field lines 302 indicate that logical high signals are being asserted on each of pixel electrodes 106(*a* and *c*). The absence of an electrical field across pixel cell 100(*b*) indicates that a logical low signal is being asserted on pixel electrode 106B. Note that in addition to the electrical fields 302 across liquid crystal layers 102(*a* and *c*), transverse fields 304 exist between pixel electrodes 106(*a* and *c*), carrying a logical high signal, and pixel electrode 106(*b*), carrying a logical low signal. Transverse fields 304 affect the polarization rotation of the light passing through liquid crystal layers 102(*a–c*), and therefore, potentially introduce visible artifacts.

Whether, and to what extent, visible artifacts are produced between adjacent pixel cells depends on the time period that logically opposite signals (i.e., high and low) are asserted on adjacent pixel electrodes. Adjacent pixel cells carrying opposite signals are said to be out of phase. The percentage of the total frame time that adjacent pixel cells are out of phase is referred to herein as the phase difference between the adjacent cells. Visible artifacts are most noticeable when adjacent pixel cells are written with gray values that are close in intensity, but have a large phase difference.

FIG. 4 is a table showing the bit values and phase differences between selected gray scale values in an eight-bit, binary-weighted, pulse-width modulation scheme. Note that gray values 127 and 128, while having an intensity difference of only one level, have a phase difference of 100%, and thus result in a visible artifact when written to adjacent pixel cells. Similarly, gray values 63 and 64 (as well as gray values 191 and 192) have a phase difference of 127/255, which also causes unacceptable image artifacts.

What is needed is a system and method for reducing the maximum possible phase difference between gray scale values asserted on adjacent pixel electrodes.

SUMMARY

A novel system and method for reducing the maximum possible phase difference between data asserted on adjacent pixel electrodes is described. The system and method employ compound data words, which comprise a first group of bits that are each asserted on a display pixel for a coequal time period, and a second group of bits that are asserted on the display pixel for a time period dependent on their significance. The maximum phase difference between adjacent gray scale values (e.g., gray scale value 79 and gray scale value 80) is thereby limited to one of the bits of the first group and all of the bits of the second group being out of phase.

In one embodiment of the invention, a display driver circuit includes an output controller configured to provide display control signals which cause each bit of the first group of data bits to be asserted on a display pixel for a coequal time period. The control signals also cause each bit of the second group of data bits to be asserted on the pixel for a time period that depends on an associated significance of each bit. Thus, each bit of the first group is asserted for a time period equal to the time period that the other bits of the first group are asserted, and each bit of the second group is asserted for a time period different than the other bits of the second group. In a particular embodiment, the length of each coequal time period is twice as long as the time period associated with the most significant bit of the second group of data bits.

Optionally, the display driver circuit includes a compound data generator, configured to provide compound data words at an output. In a particular embodiment, the compound data generator includes an input terminal for receiving a data word of a first type (e.g., binary-weighted), and the compound data words are generated responsive to receiving the data word of the first type. The compound data generator may comprise, for example, a look-up-table, an arithmetic logic unit which operates on the data word of the first type to generate the compound data word, or a memory device which retrieves a compound data word from a storage location indicated by the data word of the first type.

In a particular embodiment, the compound data generator is configured to convert a first set of the (X) most significant bits of a binary-weighted data word into $(2^X-1)$ equally-weighted bits of the compound data word, thus preserving the gray scale resolution of the binary-weighted data. In an alternate embodiment, the binary-weighted data words are capable of defining a first number of possible gray scale values, the compound data words are capable of defining a second number of possible values less than the first number of possible values, and the binary-weighted data words are mapped over to the compound data words, sacrificing some gray scale resolution.

A disclosed method for asserting a compound data word on a display pixel comprises the steps of asserting each bit of a first group of bits of the compound data word on the display pixel for a coequal time period, and asserting each bit of a second group of bits of the compound data word on the display pixel for a period of time depending on an associated significance of each bit. In a particular method, each bit of the first group is asserted on the display pixel for a time period twice the duration of the time period of the most significant bit of the second group of data bits. Optionally, the method further includes the step of generating the compound data word. In a particular method, the step of generating the compound data word comprises the steps of receiving a data word of a first type, and generating the compound data word from the data word of the first type. In more particular methods, the step of generating the compound data word from the data word of the first type comprises performing a mathematical operation on the data word of the first type, or retrieving the compound data word from a look-up-table or a memory device.

A display driver circuit and method for using compound data words in a field-sequential display driving scheme are also disclosed. The display driver circuit includes an output controller configured to provide display control signals to sequentially assert a first portion of a first compound data word, a first portion of a second compound data word, a second portion of the first compound data word, and a second portion of the second compound data word on a display pixel. A particular display driver circuit includes a compound data generator for generating the compound data words from data words of a first type (e.g., binary-weighted data words). One embodiment of the compound data generator includes a mapping unit for generating the first portions of the compound data words from the binary-weighted data words according to one predetermined mapping scheme, and for generating the second portions of the compound data words from the binary-weighted data words according to a second predefined mapping scheme. Optionally, the mapping unit also employs different mapping schemes optimized for a particular display light color. In some embodiments of the present invention, a state machine and/or an input controller generate control signals used to indicate the appropriate mapping scheme.

A field-sequential method for asserting at least two compound data words on a display pixel include the steps of asserting a first portion of a first compound data word on the display pixel, asserting a first portion of a second compound data word on the display pixel, asserting a second portion of the first compound data word on the display pixel, and asserting a second portion of the second compound data word on the display pixel. According to a particular method, the first and second compound data words are each associated with a different color of light modulated by the display pixel.

In a more particular method, the bits of the compound data words are arranged in the portions of the compound data words to minimize intensity differences between the respective portions. For example, according to one particular method, the odd numbered bits of the compound data words are included in one portion, and the even numbered bits are included in the other portion. According to an even more particular embodiment, the bits in each portion of the compound data words are further arranged to minimize differences between the shapes of the intensity response curves of the respective portions of the compound data words.

BRIEF DESCRIPTION OF THE DRAWINGS

The present invention is described with reference to the following drawings, wherein like reference numbers denote substantially similar elements:

FIG. 4 is a table showing bit values and phase differences between gray scale values in an 8-bit binary-weighted data scheme;

FIG. 6A is a table showing bit values and phase differences between selected gray scale values defined by the compound data word of FIG. 5A;

FIG. 6B is a table showing bit values and phase differences between selected gray scale values defined by the compound data word of FIG. 5B;

FIG. 7 is a table showing bit values and phase differences between selected gray scale values defined by a compound data word having six equally-weighted data bits and four binary-weighted data bits;

FIG. 8 is a table showing the number of available gray levels and the maximum phase difference between adjacent gray levels, for compound data words employing different numbers of equally-weighted data bits and binary-weighted data bits;

FIG. 11A is a block diagram detailing an alternate compound data generator;

FIG. 11B is a block diagram detailing another alternate compound data generator;

DETAILED DESCRIPTION

The present invention overcomes the problems associated with the prior art, by using compound data words to minimize the phase difference of the data asserted on adjacent pixels of a flat panel display. Specifically, the present invention describes a system and method for driving a display with compound data words. A compound data word is a data word formed by combining two groups of bits having a different weighting scheme. In a particular example, a compound data word includes a group of equally-weighted bits and a group of binary-weighted bits. In the following description, numerous specific details are set forth (e.g., the number and types of bits combined to form compound data words) in order to provide a thorough understanding of the invention. Those skilled in the art will recognize, however, that the invention may be practiced apart from these specific details. In other instances, details of well known display driver circuits and methods have been omitted, so as not to unnecessarily obscure the present invention.

Figure 5A:
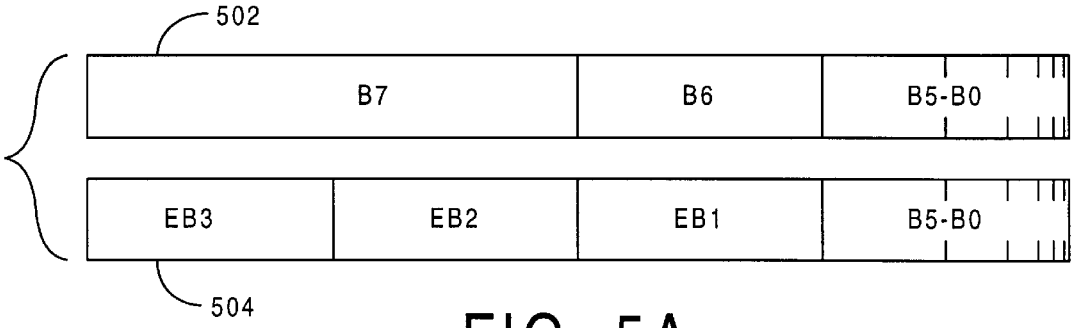
FIG. 5A is a block diagram showing the conversion of the two most significant bits of a binary-weighted data word into three equally-weighted bits of a compound data word.

FIG. 5A shows a bit-block representation of a data word 502 of a first type, in this case binary-weighted, and a compound data word 504. The length of each block represents the significance of the associated bit, and thus the amount of time the bit is to be asserted on a pixel electrode. Data word 502 has 8 bits, B7–B0, each bit having a significance of one-half the next most significant bit (binary-weighted). For example, in data word 502, block B7 is twice as long as block B6.

Compound data word 504 includes a first group of equally-weighted (equal significance) data bits, EB3–EB1, and a second group of binary-weighted data bits B5–B0. In the special case where three equally-weighted data bits are formed from bits B6 and B7 of binary-weighted data word 502, the significance of bits EB3–EB1 is the same as the significance of bit B6, and thus bit B6 may properly be considered a member of either the first group of equally-weighted data bits or the second group of binary-weighted data bits. Those skilled in the art will recognize, however, that the invention may be practiced without this relationship between the first group of equally-weighted data bits and the second group of binary-weighted data bits.

Figure 5B:
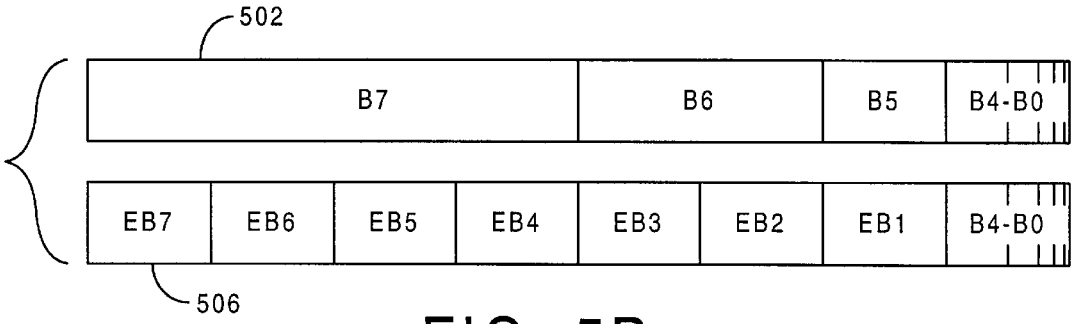
FIG. 5B is a block diagram showing the conversion of the three most significant bits of a binary-weighted data word into seven equally-weighted bits of a compound data word.

FIG. 5B shows a compound data word 506 that results from converting bits B7 and B6 of binary-weighted data word 502 into a group of equally-weighted bits EB7–EB1. Because the significance of bit EB1 is twice the significance of bit B4, bit EB1–B5 may also be considered a member of the second group of binary-weighted data bits.

FIG. 6A is a table showing bit values and phase differences between selected gray scale values defined by compound data word 504 of FIG. 5A. A maximum phase difference of 127/255 occurs between the gray scale values 127–128 and between the gray scale values 191–192. Thus, the maximum phase difference between adjacent gray scale values is approximately one-half that of the binary-weighted data word values shown in FIG. 4.

FIG. 6B is a table showing bit values and phase differences between selected gray scale values defined by compound data word 506 of FIG. 5B. A maximum phase difference of 63/255 occurs between the gray scale values 31–32, 63–64, 95–96, 127–128, 159–160, 191–192, and between the gray scale values 223–224. Thus, the maximum phase difference between adjacent gray scale values is approximately one-fourth that of the binary-weighted data word values shown in FIG. 4.

The reduction in the maximum phase difference between adjacent gray scale values comes at the expense of an increase in the number of bits that must be written to a pixel cell during one frame time. In particular, in order that a compound data word be capable of defining as many gray scale values as the binary-weighted data word from which it was formed, the (X) most significant bits of the binary-weighted data word must be converted into $(2^X-1)$ equally-weighted bits of the compound data word. For example, recall that 2 bits (B7 and B6) of binary-weighted data word 502 were converted into 3 equally-weighted bits (EB3, EB2 and EB1) of compound data word 504 (FIG. 5A). Similarly, 3 bits (B7, B6 and B5) of binary-weighted data word 502 were converted into 7 equally-weighted bits (EB7–EB1) of compound data word 506 (FIG. 5B).

As more bits of the binary-weighted data word are converted to equally-weighted bits, the maximum phase difference between adjacent gray scale values continues to decrease. The increased number of bits, however, increases the display interface bandwidth requirement. In some systems, the interface bandwidth prevents the use of enough equally-weighted bits to reduce the maximum phase difference between adjacent gray scale values to an acceptable level.

The maximum phase difference between adjacent gray scale values can, however, be reduced without adding a prohibitive number of equally-weighted bits, by reducing the gray scale resolution (number of values defined) of the compound data word. For example, an 8-bit binary-weighted data word is capable of defining 256 gray scale values. In general, (n) binary-weighted data bits are capable of defining $2^n$ gray scale values. In contrast, (m) equally-weighted data bits are capable of defining (m+1) gray scale values. Thus, a compound data word comprising a first group of (m) equally-weighted data bits and a second group of (n) binary-weighted data bits is capable of defining $(m+1)(2^n)$ gray scale values. Accordingly, the number (m) of equally-weighted data bits and the number (n) of binary-weighted data bits can be selected to define an adequate number of gray scale values. Then, data words of a first type, for example binary-weighted, can be mapped over to the compound data words having a similar value. If the compound data words are only capable of defining a number of gray scale values less than the number of values defined by the binary-weighted data words, then more than one binary-weighted data word will map over to some of the compound data words.

FIG. 7 is a table showing bit values and phase differences between selected gray scale values defined by a compound data word having six equally-weighted data bits (B9–B4) and four binary-weighted data bits (B3–B0). A maximum phase difference of 3 1/111 occurs between gray scale values 15–16, 31–32, 47–48, 63–64, 79–80, and 95–96. This maximum phase difference is comparable to the maximum phase difference (63/255, FIG. 6B) of compound data word 506, but is achieved with 2 fewer bits. However, as shown in FIG. 7, the 10-bit compound data word (B9–B0) is only capable of defining 112 different gray scale values.

FIG. 8 is a table 800 showing the number of available gray levels and the maximum phase difference between adjacent gray levels, for compound data words employing various numbers of equally-weighted data bits and binary-weighted data bits. As indicated above, a compound data word having (m) equally-weighted bits and (n) binary-weighted bits is capable of defining $(m+1)(2^n)$ gray scale values. The maximum phase difference between adjacent gray scale values is calculated by dividing the sum of the number of time intervals in one equally-weighted bit and all binary-weighted bits by the total number of time intervals in the frame time. The simplified result is as follows:

$$\frac{2^{m+1}-1}{2^m(n+1)-1}$$

This calculation assumes that as gray scale values are increased, the equally-weighted bits of the compound data word are uniformly incremented, such that no more than one equally-weighted data bit can be out of phase between adjacent gray scale levels. For example, note that for gray scale value 48 of FIG. 7, bits B6–B4 are high and bits B9–B7 are low. Because bits B9–B4 are equally-weighted, gray scale value 48 could also be written with bits B9–B7 being high and bits B6–B4 being low. This alternative representation would, however, have five of the six equally-weighted bits of gray scale value 48 out of phase with respect to gray scale value 47.

Certain relationships are apparent from table 800. First, for a given number of total bits, the number of possible gray scale values increases as the number of binary-weighted data bits increases. Additionally, as the number of equally-weighted data bits increases, the maximum phase difference between adjacent gray scale values decreases. For a given display, a particular compound data scheme (i.e., particular number of equally-weighted bits (m) and binary-weighted data bits (n)) is selected to provide the required number of gray scale levels, maintain an acceptable maximum phase difference, and operate within the system's interface bandwidth. For example, assume that in a particular display visible artifacts appear when the phase difference between adjacent gray scale values exceeds 35%, and that the system must be capable of generating 80 different gray scale levels. Table 800 indicates that 80 gray levels can be obtained using an 8-bit compound data word with 4 equally-weighted bits and 4 binary-weighted bits (4,4). However, the (4,4) scheme has a maximum phase difference of approximately 39.2%, and is, therefore, unacceptable for the system of this example. On the other hand, by using a 9-bit compound data word having 5 equally-weighted data bits and 4 binary-weighted data bits (5,4), 96 gray levels can be obtained, with an acceptable maximum phase difference of 32.6%.

In a particular embodiment, the frame time is allocated among the bits of the compound data word as follows. First, the time period allocated to each equally-weighted bit is defined to be the time that it takes to write one bit to the entire display. Then, the time period allocated to the most significant bit of the binary-weighted bits is defined to be one-half the time period allocated to each equally-weighted bit. For example, consider a system which requires 25 unit time intervals to write one bit to the entire display. In this system the time allocations to the bits of a (6,4) compound data word are as follows. Each of the six equally-weighted bits is asserted on a pixel electrode for 25 time units. Note that the number of unit times allocated to the equally-weighted bits need not be a power of two (i.e., 2, 4, 8, 16, 32, . . . ). The four binary bits are then asserted for 12.5, 6.25, 3.125, and 1.5625 time units, respectively.

Figure 1:
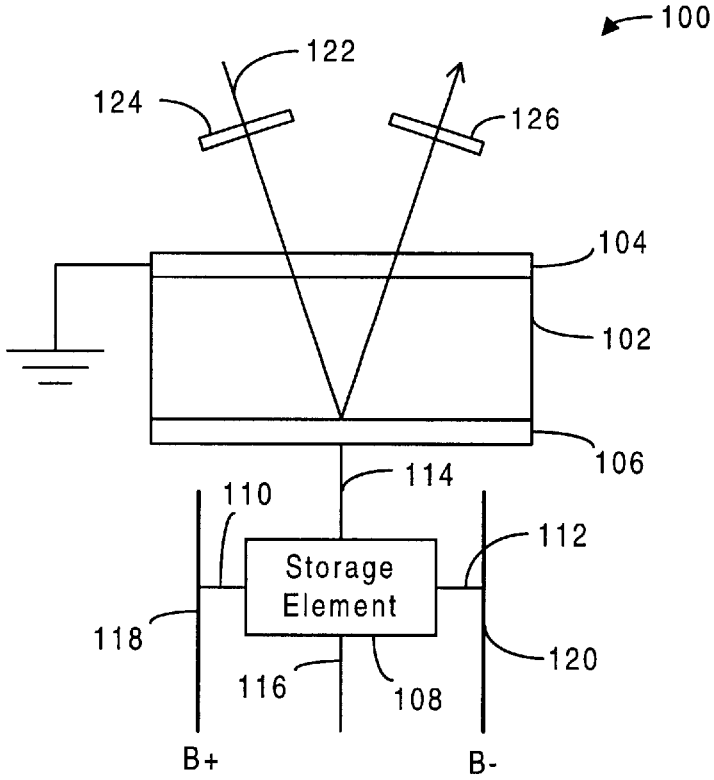
FIG. 1 Prior Art
FIG. 1 shows a single pixel cell of a liquid crystal display.
Figure 2:
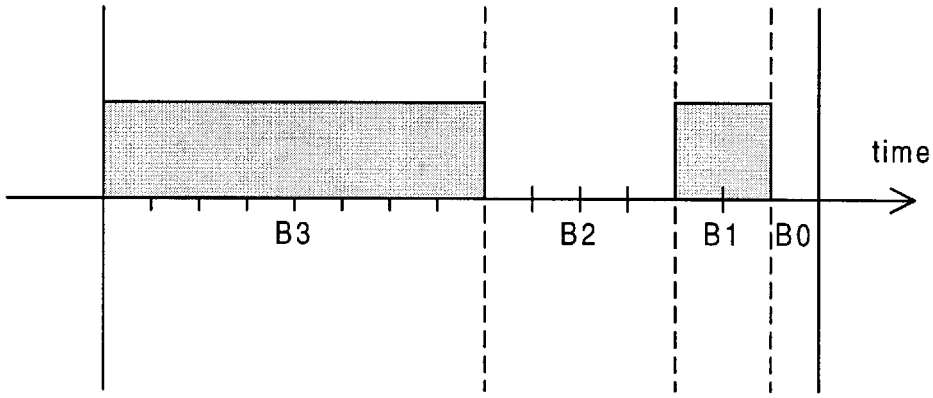
FIG. 2 Prior Art
FIG. 2 shows one frame of 4-bit pulse-width modulation data.
Figure 3:
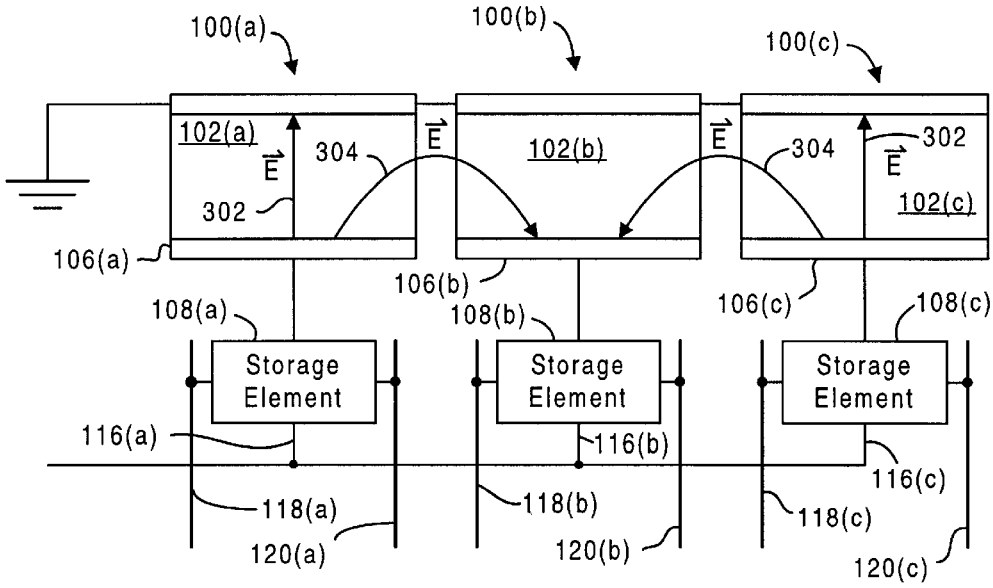
FIG. 3 Prior Art
FIG. 3 shows three adjacent pixel cells of a liquid crystal display.
Figure 9:
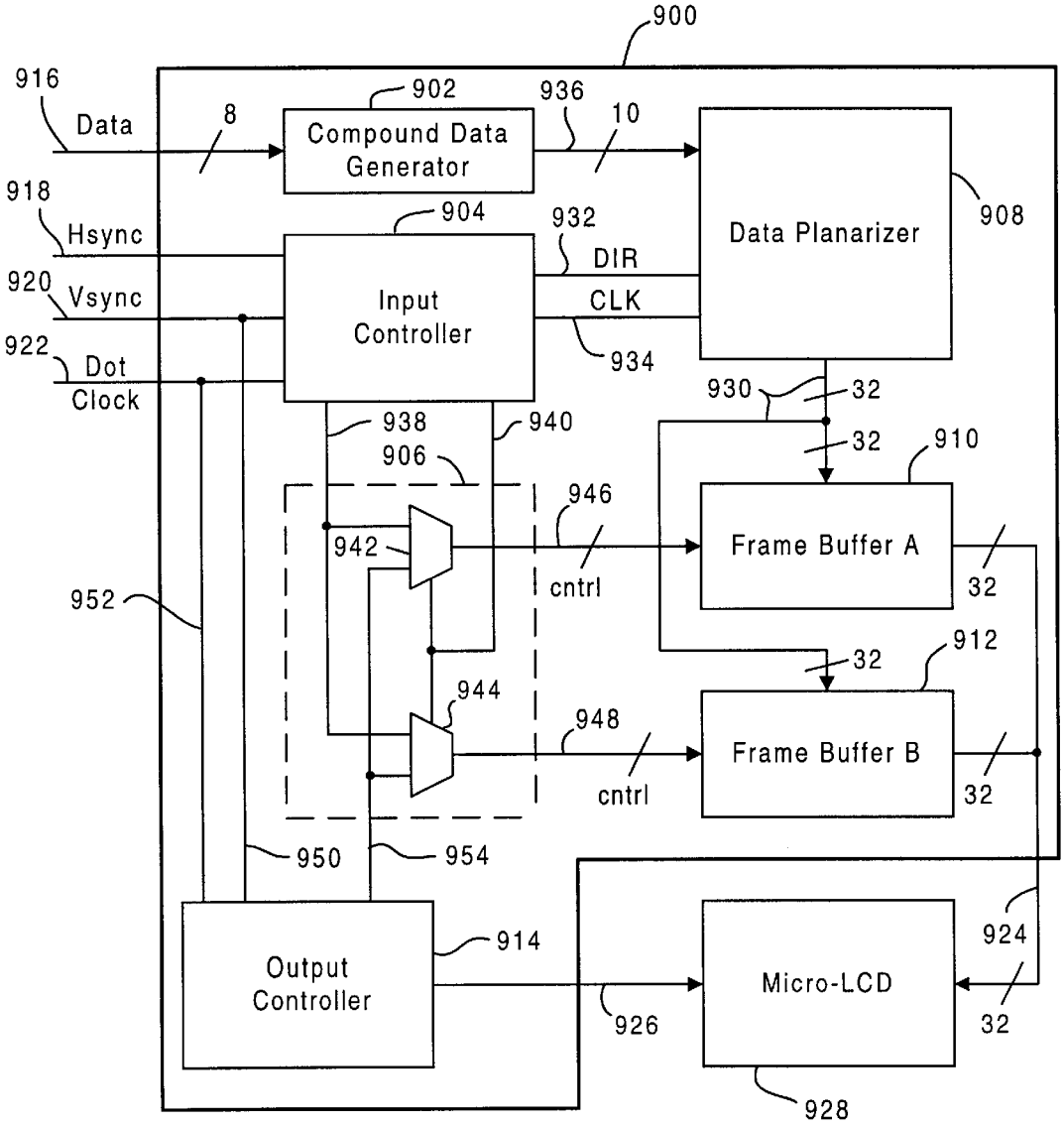
FIG. 9 is a block diagram showing a display driver circuit in accordance with the present invention.

FIG. 9 is a block diagram of a display driver circuit 900, capable of carrying out the above described compound data scheme. Display driver circuit 900 includes a compound data generator 902, an input controller 904, a control selector 906, a data planarizer 908, a frame buffer A 910, a frame buffer B912, and an output controller 914. Display driver circuit 900 receives 8-bit, binary-weighted data words, via data input bus 916, and receives horizontal synchronization (Hsync), vertical synchronization (Vsync), and pixel dot clock signals via input terminals 918, 920, and 922, respectively. After converting the received binary-weighted data words into planarized compound data words, driver circuit 900 transfers the planarized compound data words, via 32-bit data output bus 924, along with control signals, via LCD control bus 926, to a micro-LCD 928, which includes an array (1024 rows×768 columns) of liquid crystal pixel cells, similar to the pixel cell shown in FIG. 1. Display driver circuit 900 is useful in many types of systems, including, but not limited to, computer displays and video projectors.

Compound data generator 902 receives 8-bit binary-weighted data words via data input bus 916, converts the binary-weighted data words into 10-bit compound data words, and asserts the compound data words on compound data bus 936. In one embodiment, compound data generator 902 is a random access memory (RAM), which retrieves stored compound data words from memory locations indicated by the received binary-weighted data word. Those skilled in the art will understand that other memory devices, for example a read only memory (ROM) or a look-up-table, may be substituted for the RAM. In an alternate embodiment, compound data generator 902 comprises an arithmetic logic unit which performs a mathematical calculation on a received binary-weighted data word to generate a compound data word.

Data planarizer 908 receives the compound data, via compound data bus 936, in 10-bit compound data words, each 10-bits (Pr[0–9]) corresponding to a gray scale value to be written to a particular pixel (r) of micro-LCD 928. Data planarizer 908 accumulates the 10-bit gray scale data for 32 pixels and reformats the data into 32-bit data words, each 32-bit word containing one bit from each of the group of 32 10-bit compound data words. For example, the 32-bit word formed by bits P0[0]–P31 [0] includes the least significant bits of the compound data words for pixels 0–31. This reformatting is necessary because each bit of gray scale data is written to micro-LCD 928 32 pixels at a time.

Input controller 904 uses the Hsync and Vsync signals to coordinate the transfer of compound data from compound data bus 936 into data planarizer 908 and the transfer of planarized data from data planarizer 908, via 32-bit data bus 930 into frame buffers A 910 and B 912. Responsive to the Vsync and Hsync signals indicating valid data on data input bus 916, input controller 904 asserts signals on control lines DIR 932 and CLK 934, causing data to be clocked into and out of data planarizer 908. Specifically, input controller 904 clocks 32 10-bit words into data planarizer 908, and then clocks the data out as 10 32-bit words.

Frame buffer A 910 and frame buffer B 912 are each 32-bit wide synchronous graphics random access memories (SGRAMs). Each of frame buffers 910 and 912 receives data, via 32-bit data bus 930, and stores the data in a memory location associated with a particular bit significance and a particular group of pixels of micro-LCD 928. Further, each of frame buffers 910 and 912 are of sufficient capacity to store 10 bits of gray scale data for each pixel in micro-LCD 928 (i.e., one frame worth of display data). For example, because micro-LCD 828 has 786,432 pixels (1024×768), frame buffers 908 and 910 each store 7,864,320 bits (one display screen worth) of data, or 245,760 32-bit words.

The transfer of data from data bus 930 into frame buffers 910 and 912 is also controlled by input controller 904 in cooperation with control selector 906. Input controller 904 asserts frame buffer control signals on input control bus 938 and a frame buffer select signal (SEL) on select line 940. Input control bus 938 includes a write enable line and address lines for indicating the memory location into which data is to be written. Each memory location corresponds to a particular bit of a compound data word intended for a particular group of pixel cells. For example, one particular 32-bit memory location contains the first equally-weighted data bit for each of pixels 0–31.

Control selector 906 includes a first multiplexer 942 and a second multiplexer 944. First multiplexer 942 has two sets of input terminals, the first set being coupled to the lines of input control bus 938. Second multiplexer 944 also has two sets of input terminals, the second set being coupled to the lines of input control bus 938. The output of first multiplexer 942 is asserted on frame buffer A control bus 946, and the output of second multiplexer 944 is asserted on frame buffer B control bus 948.

First multiplexer 942 and second multiplexer 944 are both controlled by the SEL signal being asserted on select line 940 by input controller 904. Responsive to a first (e.g. high) SEL signal being asserted on select line 940, first multiplexer 942 couples input control bus 938 with frame buffer A control bus 946, thus allowing input controller 904 to load data from data bus 930 into frame buffer A 910. The first SEL signal also causes second multiplexer 944 to decouple input control bus 938 from frame buffer B control bus 948, so that no data is loaded into frame buffer B 912 while frame buffer A 910 is being loaded. Responsive to a second (e.g., low) SEL signal being asserted on select line 940, first multiplexer 942 decouples input control bus 938 from frame buffer A control bus 946 and couples input control bus 938 with frame buffer B control bus 948, thus allowing input controller 904 to load data from data bus 930 into frame buffer B 912. Input controller 904 toggles the SEL signal each time a Vsync signal is received, such that one display screen worth of data is written into each frame buffer 910 and 912 in alternating order.

Output controller 914 receives the Vsync signal via line 950, receives the dot clock input signal via line 952, controls the output of data from frame buffer A 910 and frame buffer B 912, and provides display control signals, via LCD control bus 926, to micro-LCD 928. Output controller 914 controls the output of data from frame buffer A 910 and frame buffer B 912 by asserting control signals on an output control bus 954, which is coupled to the second set of input terminals of first multiplexer 942 and to the first set of input terminals of second multiplexer 944. Thus, when the second SEL signal is asserted on select line 940 by input controller 904, first multiplexer 942 decouples input control bus 938 from and couples output control bus 954 to frame buffer A control bus 946, thus allowing output controller 914 to cause frame buffer A 910 to assert data onto data bus 924. On the other hand, when the first SEL signal is asserted on select line 940, second multiplexer 944 decouples input control bus 938 from and couples output control bus 954 to frame buffer B control bus 948, allowing output controller 914 to cause frame buffer B 912 to assert data onto data bus 924. Thus, while pixel data for one frame is being loaded into frame buffer A 910 by input controller 904, pixel data for the previous frame is being outputted from frame buffer B 912 by output controller 914, and vice versa.

Output controller 914 controls the amount of time that the bits of compound data words are asserted on the pixel electrodes as follows. First, output controller 914 asserts control signals on output control bus 954 causing frame buffer A 910 or frame buffer B 912 (depending on the current state of the SEL signal) to assert the contents of an indicated memory location on data bus 924. Then, output controller 914 asserts control signals on LCD control bus 926, causing micro-LCD 928 to load the bits asserted on data bus 924 onto the appropriate pixel cells. The loaded data remains on the pixel cells until output controller 914 writes the next bit to the pixel cells, a time controlled by output controller 914 to correspond to the significance of the previously loaded bit. Thus, each bit of data remains on the appropriate pixel electrode for a period of time dependent on the significance of the bit.

Figure 10:
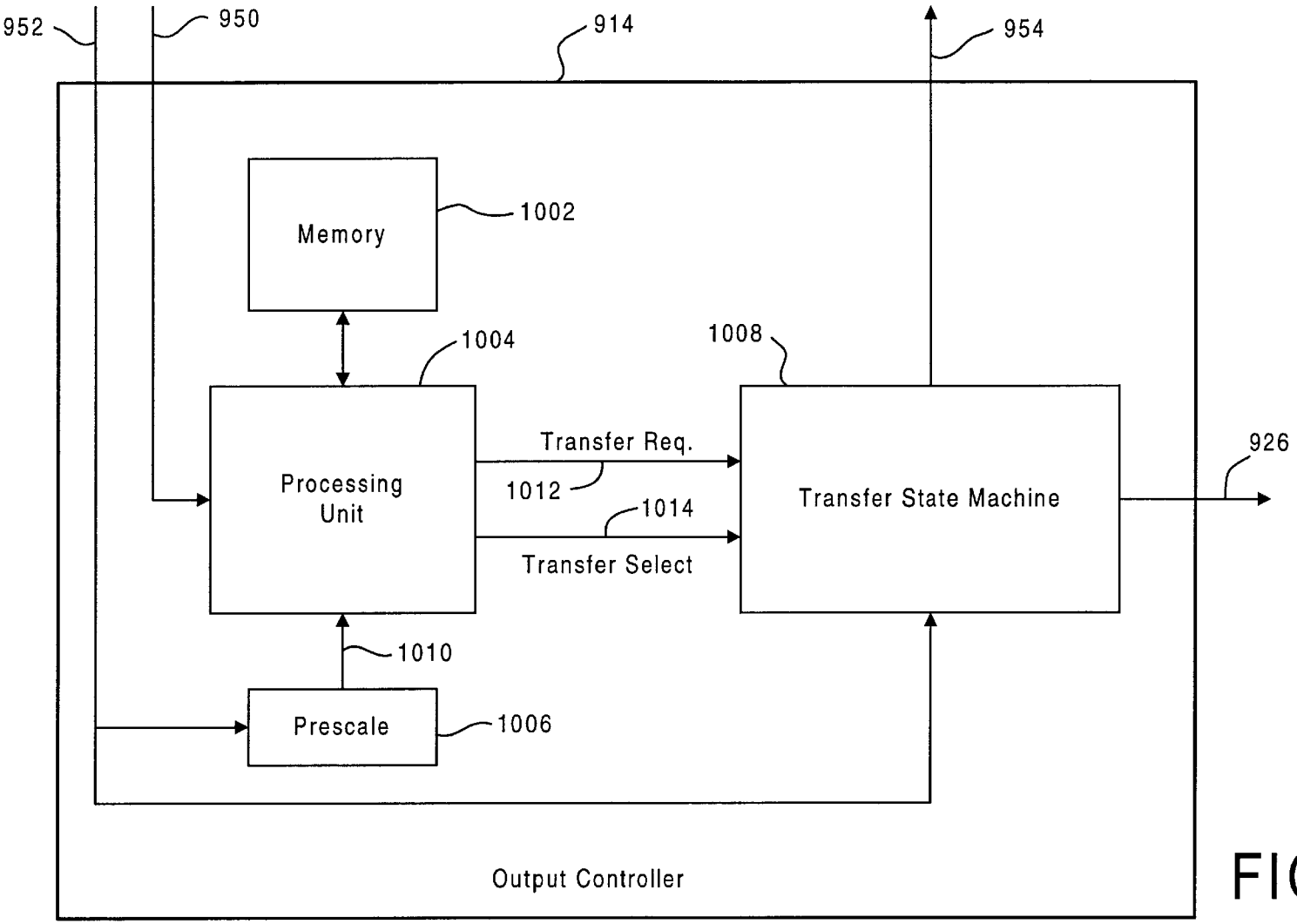
FIG. 10 is a block diagram detailing an output controller shown in FIG. 9.

FIG. 10 is a block diagram showing output controller 914 in greater detail, to include a memory 1002, a processing unit 1004, a prescale 1006, and a transfer state machine 1008. Memory 1002 is a program storage device, which stores data and commands for access and execution by processing unit 1004. Prescale 1006 receives the dot clock signal via line 952, generates a lower frequency timing signal (e.g., ½ the frequency of the dot clock), and communicates the timing signal, via line 1010 to processing unit 1004. The lower frequency timing signal enables processing unit 1004 to employ smaller scale components, for example, smaller counters.

Processing unit 1004 controls transfer state machine 1008 via a transfer request line 1012 and a transfer select bus 1014. Responsive to the signals received from processing unit 1004, transfer state machine 1008 asserts control signals on LCD control bus 926 and output control bus 954, as follows. Transfer select line 1014 is a multi-bit line used to communicate the address of the memory block to be transferred out of frame buffer A 910 or frame buffer B 912. Transfer state machine 1008 uses the block address to initialize the memory address asserted on output control bus 954, and then, responsive to a series of transfer request signals on transfer request line 1012, sequentially increments the memory address while asserting write signals on LCD control bus 926.

Those skilled in the art will recognize that the data need not be written to the display in any particular order, as long as each bit of the compound data word intended for a particular pixel is asserted on that pixel for a portion of the entire frame time corresponding to the significance of the asserted bit. For example, memory 1002 may be programmed such that output controller 914 provides control signals causing bits of a first significance to be written to a first group of pixels. Then, while the bits of the first significance are being asserted on the first group of pixels, output controller 914 may write bits of another significance to another group of pixels. This advantageously eliminates the need to write data to the entire display in the relatively short time period corresponding to the least significant bit. Memory 1002 may be programmed with code for causing data to be written to display 928 in any advantageous order.

In one embodiment, forced state controller 914 is implemented with a programmable logic device part number EPF10K50 BC356-3, manufactured by Altera Corporation of Santa Clara, Calif. The verilog code for programming this device in accordance with the present invention is attached hereto as a microfiche appendix.

FIG. 11A is a block diagram detailing an alternate compound data generator 1100, capable of generating a 9-bit compound data word from an 8-bit binary-weighted data word, by converting the two most significant binary-weighted bits (B7 and B6) into three equally-weighted bits (EB1–EB3). Compound data generator 1100 receives the 8-bit binary-weighted data words via an 8-bit (B7:B0) data input bus 1102, and asserts the compound data words on an output bus including binary-weighted bit lines 1104, first equally-weighted bit (EB1) line 1106, second equally-weighted bit (EB2) line 1108, and third equally-weighted bit (EB3) line 1110. Because the generated compound data word includes bits B5–B0 of the received binary-weighted data word, bit lines B5–B0 of data input bus 1102 are coupled to bit lines B5–B0 of binary-weighted bit lines 1104, respectively.

Compound data generator 1100 further includes a logical OR gate 1112 and a logical AND gate 1114, and generates EB1–EB3 as follows. EB1 is generated by OR gate 1112, which is coupled to logically combine bits B7 and B6 of data input bus 1102, and assert the product (B7 OR B6) on (EB1) line 1106. EB2 is generated by coupling bit B7 of data input bus 1102 to EB2 line 1108 (EB4=B7). EB3 is generated by AND gate 1114, which is coupled to logically combine bits B7 and B6 of data input bus 1102, and assert the product (B7 AND B6) on (EB3) line 1110. Those skilled in the art will understand that other equivalent combinational logic arrays may be substituted for OR gate 1112 and AND gate 1114.

FIG. 11B is a block diagram detailing an alternate compound data generator 1140, capable of generating a 12-bit compound data word from an 8-bit binary-weighted data word, by converting the three most significant binary-weighted bits (B7, B6, and B5) into seven equally-weighted bits (EB1–EB7). Compound data generator 1140 receives the 8-bit binary-weighted data words via an 8-bit (B7:B0) data input bus 1142, and asserts the compound data words on an output bus including binary-weighted bit lines 1144, first equally-weighted bit (EB1) line 1146, second equally-weighted bit (EB2) line 1148, third equally-weighted bit (EB3) line 1150, fourth equally-weighted bit (EB4) line 1152, fifth equally-weighted bit (EB5) line 1154, sixth equally-weighted bit (EB6) line 1156, and seventh equally-weighted bit (EB7) line 1156. Because the generated compound data word includes bits B4–B0 of the received binary-weighted data word, bit lines B4–B0 of data input bus 1142 are coupled to bit lines B4–B0 of binary-weighted bit lines 1144, respectively.

Compound data generator 1140 further includes a first OR gate 1160, a second OR gate 1162, a third OR gate 1164, a fourth OR gate 1166, a first AND gate 1168, a second AND gate 1170, a third AND gate 1172, and a fourth AND gate 1174, and generates equally-weighted bits EB1–EB7 as follows. EB1 is generated by first OR gate 1160, which is coupled to logically combine bits B7, B6, and B5, and assert the product (B7 OR B6 OR B5) on EB1 lines 1146. EB2 is generated by second OR gate 1162, which is coupled to logically combine bits B7 and B6, and assert the product (B7 OR B6) on EB2 line 1148. EB3 is generated by first AND gate 1168, which is coupled to logically combine bits B5 and B6, and third OR gate 1164, which is coupled to logically combine the output of first AND gate 1168 with bit B7, and assert the product ([B6 AND B5] OR B7) on EB3 line 1150. EB4 is generated by coupling bit line B7 of data input bus 1142 (EB4=B7) to EB4 line 1152. EB5 is generated by fourth OR gate 1166, which is coupled to logically combine bits B5 and B6, and second AND gate 1170, which is coupled to logically combine the output of fourth OR gate 1166 with bit B7, and assert the product ([B6 OR B5] AND B7) on EB5 line 1154. EB6 is generated by third AND gate 1172, which is coupled to logically combine bits B7 and B6, and assert the product (B7 AND B6) on EB6 line 1156. EB7 is generated by fourth AND gate 1174, which is coupled to logically combine B7, B6, and B5, and assert the product (B7 AND B6 AND B5) on EB7 line 1158.

Those skilled in the art will understand that any equivalent logic circuit may be substituted for the above described logic gates of compound data generator 1140. Those skilled in the art will also understand that display driver circuit 900 would require routine modifications (e.g., a planarizer capable of planarizing 9-bit or 12-bit compound data words) in order to employ alternate compound data generator 1100 or alternate compound data generator 1140. Further, in view of this disclosure, those skilled in the art will understand that combinational logic may be used to generate $(2^X-1)$ equally-weighted data bits from any number (X) of binary-weighted data bits.

Figure 12:
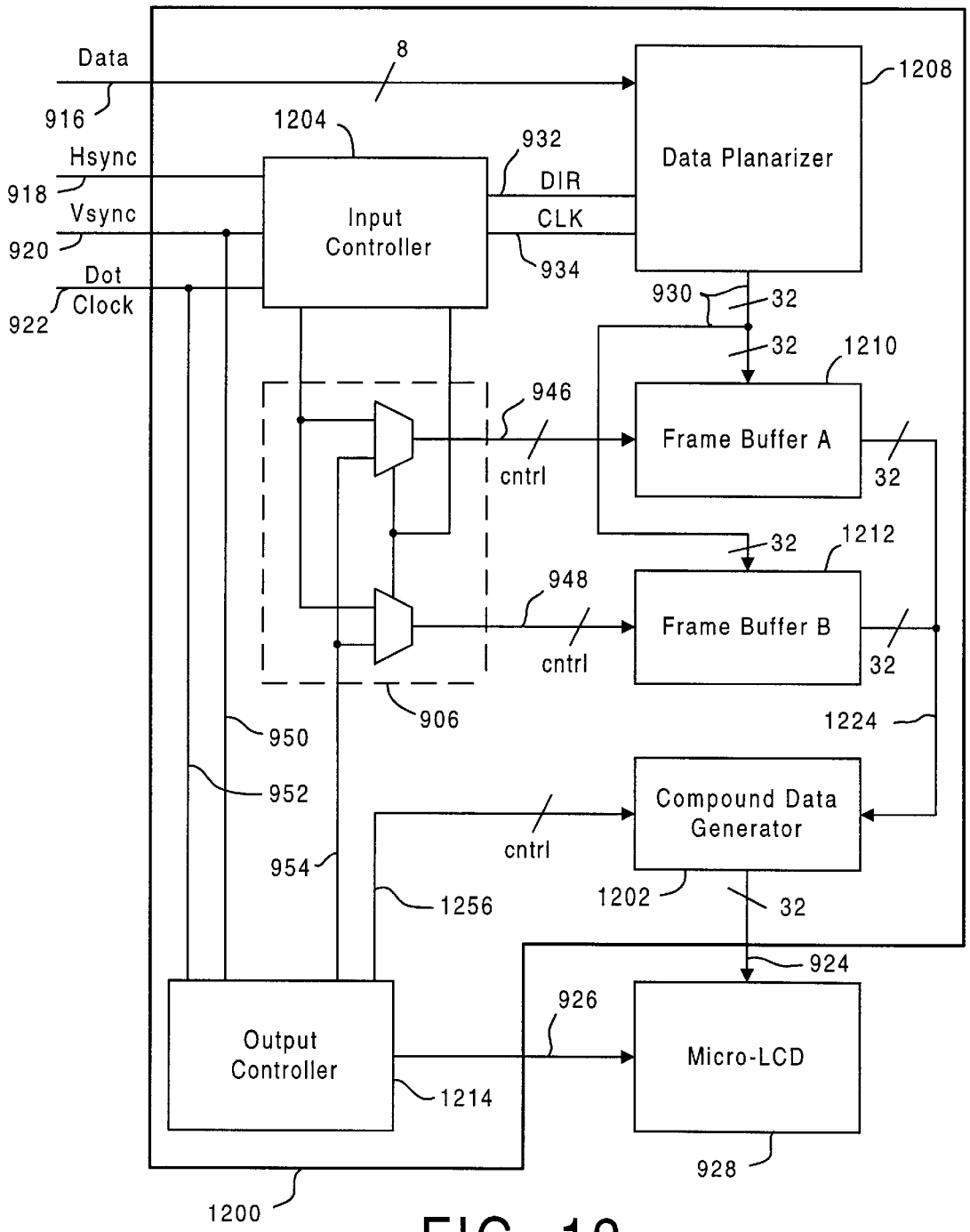
FIG. 12 is a block diagram showing an alternate display driver circuit in accordance with the present invention.

FIG. 12 is a block diagram showing an alternate display driver circuit 1200, in accordance with the present invention. Display driver circuit 1200 includes a compound data generator 1202, an input controller 1204, a control selector 906, a data planarizer 1208, a frame buffer A 1210, a frame buffer B 1212, and an output controller 1214. Display driver circuit 1200 receives 8-bit, binary-weighted data words, via data input bus 916, and receives horizontal synchronization (Hsync), vertical synchronization (Vsync), and pixel dot clock signals via input terminals 918, 920, and 922, respectively. After converting the received binary-weighted data words into planarized compound data words, driver circuit 1200 transfers the planarized compound data words, via 32-bit data output bus 924, along with control signals, via LCD control bus 926, to micro-LCD 928.

Display driver circuit 1200 differs from display driver circuit 900 in that compound data is generated from planarized binary-weighted data. In other words, compound data generator 1202 is disposed downstream (data stream) from data planarizer 1208 in display driver circuit 1200, whereas compound data generator 902 is disposed upstream from data planarizer 908 in display driver circuit 900. This change necessitates/allows some modifications to the various components of display driver circuit 1200, with respect to display driver circuit 900, as will be explained below.

Data planarizer 1208 receives binary-weighted data, via data input bus 916, in 8-bit data words, each 8-bits (Pr[0–7]) corresponding to a gray scale value to be written to a particular pixel (r) of micro-LCD 928. Data planarizer 1208 accumulates the 8-bit gray scale data for 32 pixels and reformats the data into 32-bit data words, each 32-bit word containing one bit from each of the group of 32 8-bit binary-weighted data words. For example, the 32-bit word formed by bits P0[0]–P31 [0] includes the least significant bits of the binary-weighted data words for pixels 0–31. Because it planarizes 8-bit data, data planarizer 1208 need only be 8 bits wide, as opposed to 10-bit wide data planarizer 908, thus allowing a beneficial size reduction of approximately 20%.

Input controller 1204 uses the Hsync and Vsync signals to coordinate the transfer of binary-weighted data from data input bus 916 into data planarizer 1208 and the transfer of planarized data from data planarizer 1208, via 32-bit data bus 930, into frame buffers A 1210 and B 1212. Responsive to the Vsync and Hsync signals indicating valid data on data input bus 916, input controller 1204 asserts signals on control lines DIR 932 and CLK 934, causing data to be clocked into and out of data planarizer 1208. Input controller 1204 is substantially identical to input controller 904, except that input controller 1204 clocks 32 8-bit words into data planarizer 1208, and then clocks the data out as 8 32-bit words. Thus, approximately 5% fewer clock cycles are required to planarize binary-weighted data, as compared to the planarization of compound data.

Frame buffer A 1210 and frame buffer B 1212 are substantially identical to frame buffer A 910 and frame buffer B 912, respectively, except that frame buffer A 1210 and frame buffer B 1212 have a smaller capacity, and are, therefore, less expensive to manufacture. Specifically, each of frame buffers 1210 and 1212 are of sufficient capacity to store 8 bits of gray scale data for each pixel in micro-LCD 928 (i.e., one frame worth of display data). For example, because micro-LCD 828 has 786,432 pixels (1024×768), frame buffers 808 and 810 each store 6,291,456 bits (one display screen worth) of data, or 196,608 32-bit words.

Input controller 1204, in cooperation with control selector 906, also controls he transfer of data asserted on data bus 930 by data planarizer 1208 into frame buffers 1210 and 1212. In this respect, input controller 1204 is substantially identical to input controller 904.

Output controller 1214 controls the output of data from frame buffer A 1210 and frame buffer B 1212, and provides display control signals, via LCD control bus 926, to micro-LCD 928, as described above with respect to output controller 914. Output controller 1214 further provides control signals, via control bus 1256, to compound data generator 1202, which are used to convert binary-weighted data into compound data. The number of bit-lines in control bus 1256 depends on the number of binary-weighted data bits that are to be converted to equally-weighted data bits, as will be described below. Compound data generator 1202 receives 32-bit planarized, binary-weighted data, via data bus 1224, uses the planarized binary-weighted data to generate planarized compound data, and asserts the planarized compound data on compound data output bus 924, all under the control of output controller 1214. Programming output controller 1214 to provide the necessary control signals is well within the abilities of those skilled in the art, particularly in light of the detailed description of compound data generator 1202 provided below.

Figure 13:
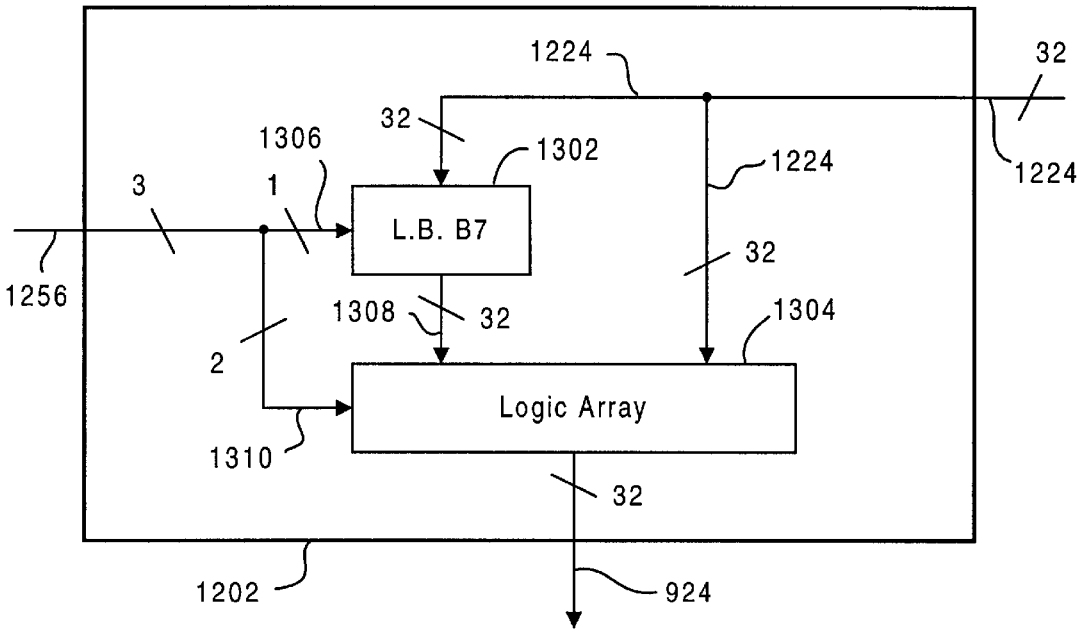
FIG. 13 is a block diagram of a compound data generator shown in FIG. 12.

FIG. 13 is a block diagram showing compound data generator 1202 in greater detail to include a line buffer 1302 and a logic array 1304. This embodiment of compound data generator 1202 generates 3 equally-weighted data bits (EB1, EB2, and EB3) from the 2 most significant bits (B7 and B6) of the binary-weighted data. Responsive to control signals received via 1 line 1306 of 3-bit control bus 1256, line buffer 1302 receives, via data bus 1224, a 32-bit planarized binary-weighted data word made up of the most significant binary-weighted bits (B7) of the data intended for 32 adjacent pixels. Line buffer 1302 stores the data, and asserts the stored 32-bit data word on data lines 1308. Then, responsive to control signals from output controller 1214 (FIG. 12), either frame buffer A 1210 or frame buffer B 1212 asserts a 32-bit data word made up of the next most significant binary-weighted bits (B6), intended for the same 32 adjacent pixels, on data bus 1224. Finally, responsive to control signals received via 2 lines 1310 of control bus 1256, logic array 1304 logically combines the binary-weighted bits (B7 and B6) to generate one of the equally-weighted bits (EB1–EB3), and asserts the equally-weighted bit on data output bus 924.

Logic array 1304 also asserts the less significant binary-weighted data bits (B5–B0) on data output bus 924. In particular, responsive to control signals received from output controller 1214, via 2 lines 1310 of control bus 1256, logic array 1304 selectively couples data bus 1224 with data output bus 924. Thus, binary-weighted bits asserted on data bus 1224 by frame buffers A 1210 and B 1212 are also asserted on data output bus 924.

Figure 14:
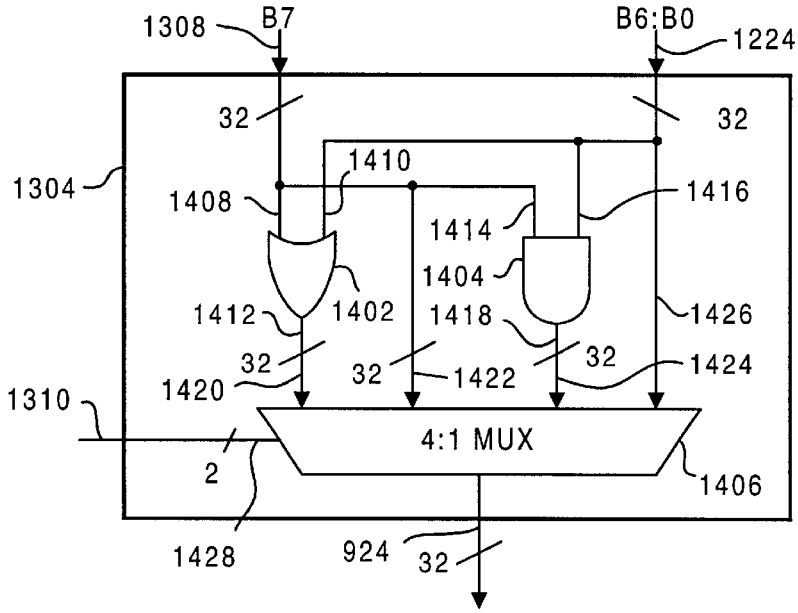
FIG. 14 is a block diagram detailing a logic array shown in FIG. 13.

FIG. 14 is a block diagram showing logic array 1304 in greater detail to include an OR gate 1402, an AND gate 1404, and a 4:1 multiplexer 1406. OR gate 1402 has a first set 1408 of 32 input terminals, a second set 1410 of 32 input terminals, and a set 1412 of 32 output terminals. AND gate 1404 has a first set 1414 of 32 input terminals, a second set 1416 of 32 input terminals, and a set 1418 of 32 output terminals. Multiplexer 1406 has a first set 1420 of 32 input terminals coupled to output terminals 1412 of OR gate 1402, a second set 1422 of 32 input terminals coupled to data lines 1308, a third set 1424 of 32 input terminals coupled to output terminals 1418 of AND gate 1404, a fourth set 1426 of 32 input terminals coupled to data bus 1224, and a set 1428 of 2 control terminals coupled to 2 lines 1310 of control bus 1256.

OR gate 1402 logically combines each input terminal of first set 1408 with a corresponding input terminal of second set 1410, and asserts the logical product on a corresponding output terminal of set 1412. AND gate 1404 logically combines each input terminal of first set 1414 with a corresponding input terminal of second set 1416, and asserts the logical product on a corresponding output terminal of set 1418. Responsive to control signals received on control terminals 1428, multiplexer 1406 selectively couples one of input terminal sets 1420, 1422, 1424, or 1426 with data output bus 924.

Thus configured, logic array 1304 can output each bit of a compound data word. When B7 and B6 are asserted on data lines 1308 and data bus 1224, respectively, multiplexer 1406 outputs equally-weighted bits EB1–EB3 by selectively coupling data output bus 924 with one of input terminal sets 1420, 1422, or 1424, corresponding to the desired logical combination. In particular, first input terminal set 1420 corresponds to EB1 (EB1=B7 OR B6), second input terminal set 1422 corresponds to EB2 (EB2=B7), and third input terminal set 1424 corresponds to EB3 (EB3=B7 AND B6). Multiplexer 1406 outputs binary-weighted bits by selectively coupling input terminal set 1426 with data output bus 924, when one of frame buffers A 1210 or B 1212 is asserting one of binary-weighted bits B5–B0 on data bus 1224.

Figure 15:
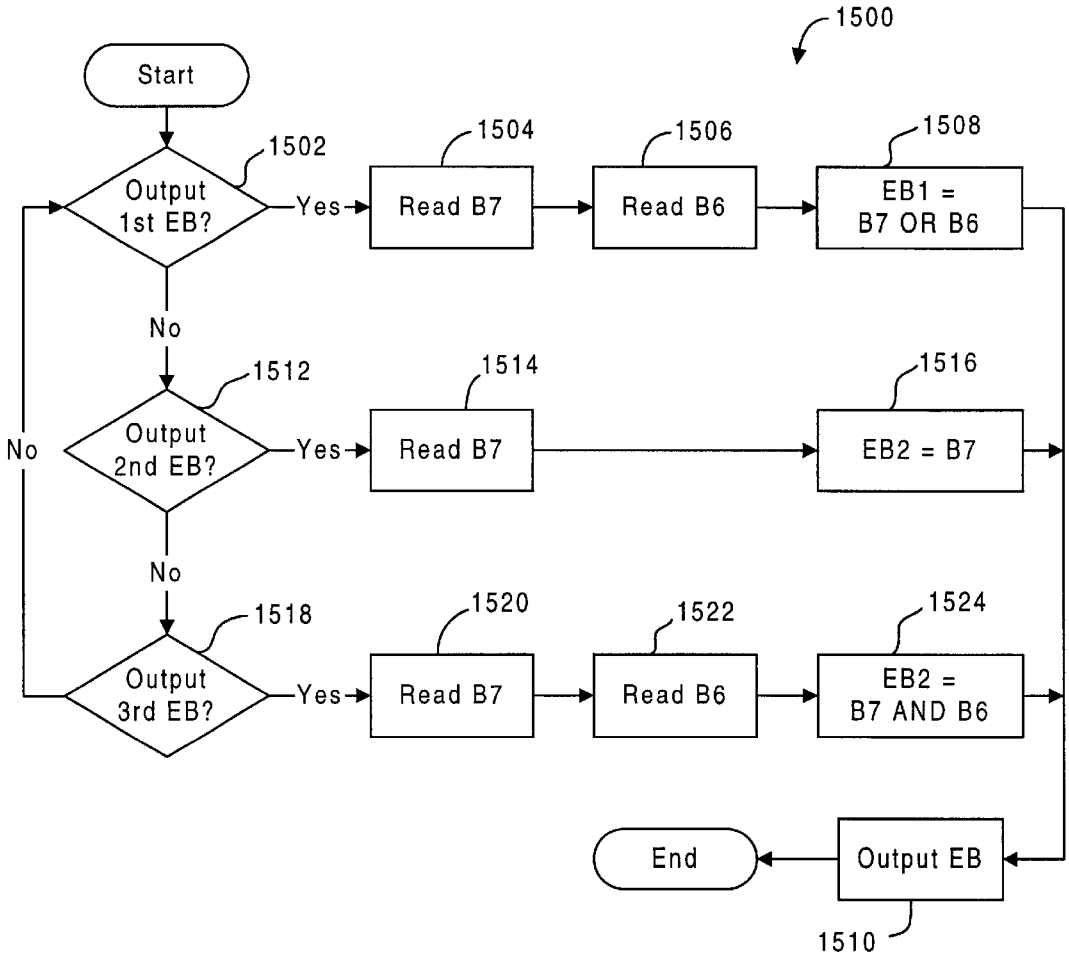
FIG. 15 is a flow chart showing a method for generating 3 equally-weighted data bits from 2 binary-weighted data bits.

FIG. 15 is a flow chart showing a method 1500 for generating 3 equally-weighted data bits (EB1, EB2, and EB3) from 2 binary-weighted data bits (B7 and B6). Method 1500 is described from the perspective of compound data generator 1202, but those skilled in the art will recognize that compound data generator 1202, as well as frame buffers A 1210 and B 1212, act under the control of output controller 1214. For example, in order for compound data generator 1202 to "read" a line of data bits (e.g., B7), output controller 1214 must provide control signals to one of frame buffers A 1210 or B 1212 causing B7 to be asserted on data bus 1224, and must provide control signals to compound data generator 1202 causing line buffer 1302 to load the asserted data.

In a first step 1502, output controller 1214 determines whether the first equally-weighted bit (EB1) is to be generated. If EB1 is to be generated, then in a second step 1504 compound data generator reads B7 into line buffer 1302. Next, in a third step 1506, compound data generator 1202 reads B6 (i.e., frame buffer A 1210 or B 1212 asserts B6 on data bus 1224). Then, in a fourth step 1508, OR gate 1402 logically combines B7 and B6 to generate EB1, and in a fifth step 1510, multiplexer 1406 outputs EB1 by coupling first input terminal set 1420 with data output bus 924, afterwhich method 1500 ends.

If, in first step 1502, output controller 1214 determines that EB1 is not to be generated, then in a sixth step 1512, output controller 1214 determines whether the second equally-weighted bit (EB2) is to be generated. If EB2 is to be generated, then in a seventh step 1514 compound data generator 1202 reads B7 into line buffer 1302. Next, in an eighth step 1516, logic array 1304 sets EB2 equal to B7 (second set of input terminals 1422 coupled to data lines 1308). Method 1500 then proceeds to fifth step 1510, where multiplexer 1406 outputs EB2 by coupling second input terminal set 1422 with data output bus 924, afterwhich method 1500 ends.

If, in sixth step 1512, output controller 1214 determines that EB2 is not to be generated, then in a ninth step 1518, output controller 1214 determines whether the third equally-weighted bit (EB3) is to be generated. If EB3 is to be generated, then in a tenth step 1520 compound data generator reads B7 into line buffer 1302, and in an eleventh step 1522 reads B6. Then, in a twelfth step 1524, AND gate 1416 logically combines B7 and B6 to generate EB3, and method 1500 proceeds to fifth step 1510, where multiplexer 1406 outputs EB3 by coupling third input terminal set 1424 with data output bus 924. If, in ninth step 1518, output controller determines that EB3 is not to be generated, then method 1500 returns to first step 1502.

Figure 16:
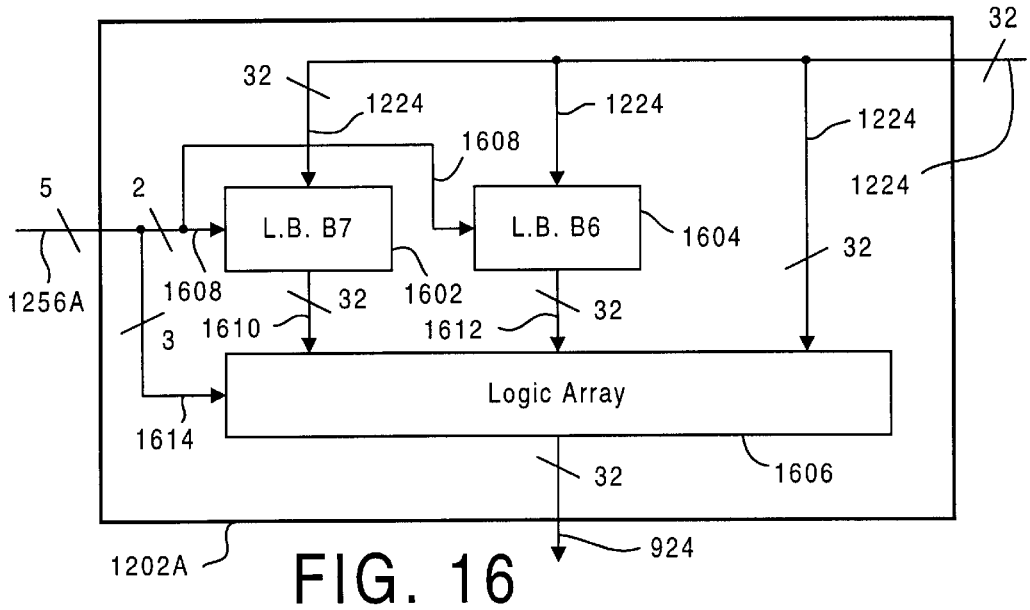
FIG. 16 is a block diagram showing an alternate compound data generator.

FIG. 16 is a block diagram showing an alternate compound data generator 1202A in greater detail to include a first line buffer 1602, a second line buffer 1604, and a logic array 1606. This embodiment of compound data generator 1202A generates 7 equally-weighted data bits (EB1–EB7) from the 3 most significant bits (B7–B5) of the binary-weighted data. Responsive to control signals received via 2 lines 1608 of 5-bit control bus 1256A, first line buffer 1602 and second line buffer 1604 receive, via data bus 1224, 32-bit planarized binary-weighted data words made up of the most significant binary-weighted bits (B7) and the next most significant binary-weighted bits (B6), respectively. Line buffers 1602 and 1604 store the data, and assert the stored 32-bit data words on data lines 1610 and data lines 1612, respectively. Then, responsive to control signals from output controller 1214 (FIG. 12), either frame buffer A 1210 or frame buffer B 1212 asserts a 32-bit data word made up of the next most significant binary-weighted bit (B5) on data bus 1224. Finally, responsive to control signals received via 3 lines 1614 of control bus 1256A, logic array 1606 logically combines the binary-weighted bits (B7–B5) to generate one of the equally-weighted bits (EB1–EB7), and asserts the equally-weighted bit on data output bus 924.

Logic array 1606 also asserts the less significant binary-weighted data bits (B4–B0) on data output bus 924. In particular, responsive to control signals received from output controller 1214, via 3 lines 1614 of control bus 1256A, logic array 1606 selectively couples data bus 1224 with data output bus 924. Thus, binary-weighted bits asserted on data bus 1224 by frame buffers A 1210 and B 1212 are also asserted on data output bus 924.

Figure 17:
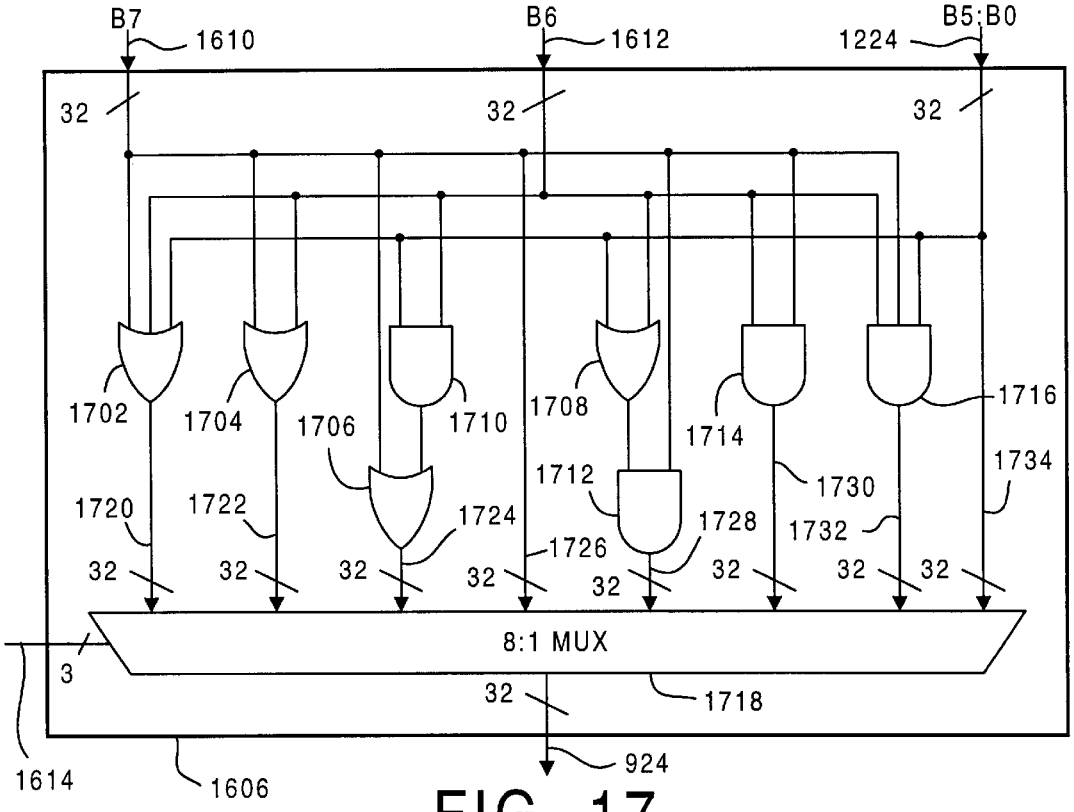
FIG. 17 is a block diagram detailing a logic array shown in FIG. 16.

FIG. 17 is a block diagram showing logic array 1606 in greater detail to include a first OR gate 1702, a second OR gate 1704, a third OR gate 1706, a fourth OR gate 1708, a first AND gate 1710, a second AND gate 1712, a third AND gate 1714, a fourth AND gate 1716, and an 8:1 multiplexer 1718.

Logic array 1606 generates equally-weighted bits EB1–EB7 as follows. EB1 is generated by first OR gate 1702, which is coupled to logically combine bits B7, B6, and B5, and assert the product (B7 OR B6 OR B5) on a first input terminal set 1720 of multiplexer 1718. EB2 is generated by second OR gate 1704, which is coupled to logically combine B7 and B6, and assert the product (B7 OR B6) on a second input terminal set 1722 of multiplexer 1718. EB3 is generated by first AND gate 1710, which is coupled to logically combine bits B5 and B6, and third OR gate 1706, which is coupled to logically combine the output of first AND gate 1710 with bit B7, and assert the product ([B6 AND B5] OR B7) on a third input terminal set 1724 of multiplexer 1718. EB4 is generated by coupling data lines 1610 (EB4=B7) to a fourth input terminal set 1726 of multiplexer 1718. EB5 is generated by fourth OR gate 1708, which is coupled to logically combine bits B5 and B6, and second AND gate 1712, which is coupled to logically combine the output of fourth OR gate 1708 with bit B7, and assert the product ([B6 OR B5] AND B7) on a fifth input terminal set 1728 of multiplexer 1718. EB6 is generated by third AND gate 1714, which is coupled to logically combine B7 and B6, and assert the product (B7 AND B6) on a sixth input terminal set 1730 of multiplexer 1718. EB7 is generated by fourth AND gate 1716, which is coupled to logically combine B7, B6, and B5, and assert the product (B7 AND B6 AND B5) on a seventh input terminal set 1732 of multiplexer 1718. Responsive to control signals received via 3 lines 1614 of control bus 1256A, multiplexer 1718 selectively asserts bits EB1–EB7 on data output bus 924.

Binary-weighted bits (B4–B0) are generated by coupling an eighth input terminal set 1734 of multiplexer 1718 to data bus 1224. Responsive to control signals received via 3 lines 1614 of control bus 1256A, multiplexer 1718 couples eighth input terminal set 1734 to data output bus 924, so that when bits B4–B0 are asserted on data bus 1224 by one of frame buffers A 1210 or B 1212, bits B4–B0 are also asserted on data output bus 924.

Figure 18:
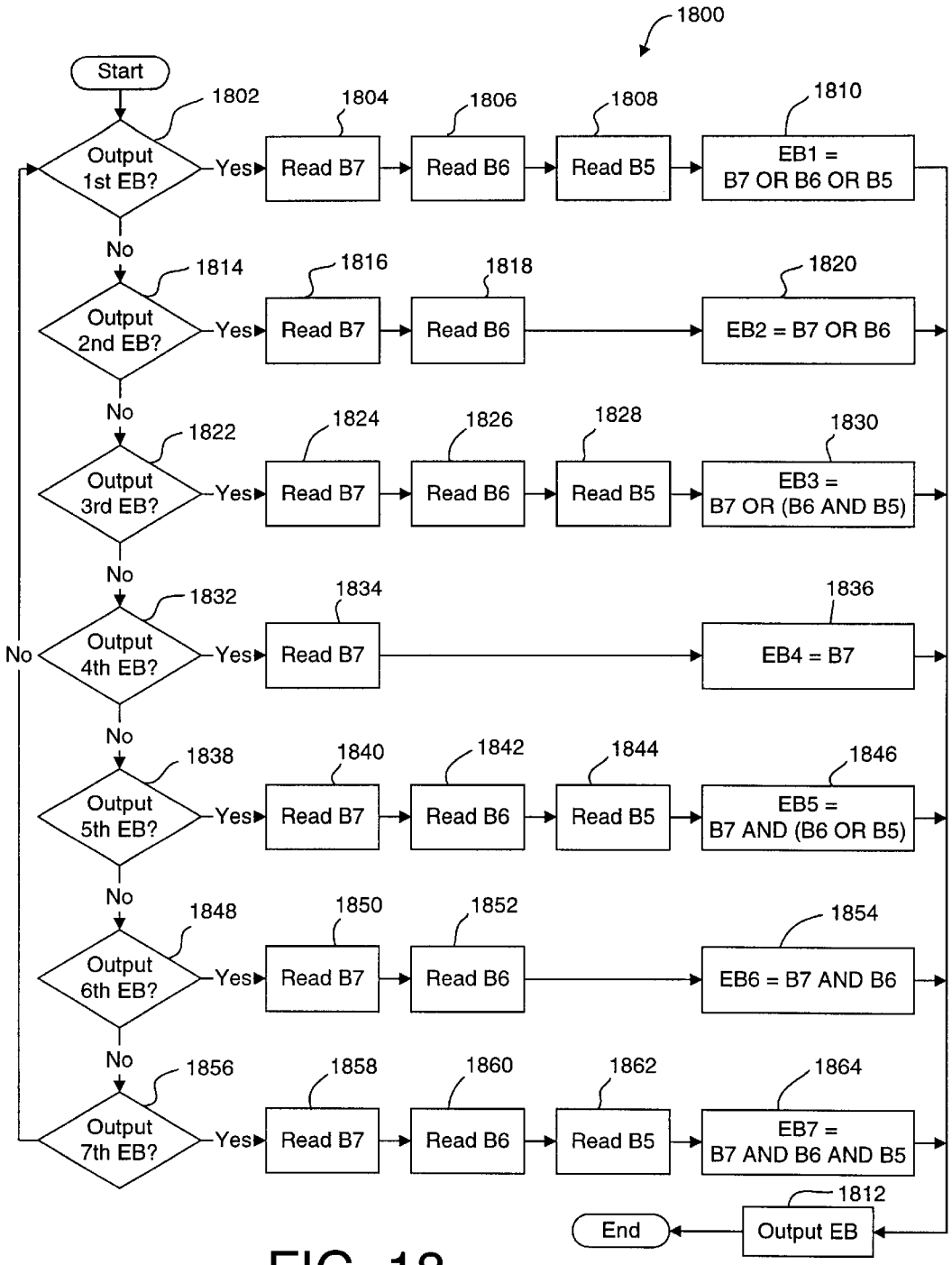
FIG. 18 is a flow chart showing a method for generating 7 equally-weighted data bits from 3 binary-weighted data bits.

FIG. 18 is a flow chart showing a method 1800 for generating 7 equally-weighted data bits (EB1–EB7) from 3 binary-weighted data bits (B7–B5). In a first step 1802, output controller 1214 determines whether the first equally-weighted bit (EB1) is to be generated. If EB1 is to be generated, then in a second step 1804 compound data generator 1202A reads B7 into line buffer 1602, and in a third step 1806 reads B6 into line buffer 1604. Next, in a fourth step 1808, compound data generator 1202A reads B5 (i.e., frame buffer A 1210 or B 1212 asserts B6 on data bus 1224). Then, in a fifth step 1810, OR gate 1702 logically combines B7, B6, and B5 to generate EB1, and in a sixth step 1812, multiplexer 1718 outputs EB1 by coupling first input terminal set 1720 with data output bus 924, afterwhich method 1800 ends.

If, in first step 1802, output controller 1214 determines that EB1 is not to be generated, then in a seventh step 1814, output controller 1214 determines whether the second equally-weighted bit (EB2) is to be generated. If EB2 is to be generated, then in an eighth step 1816 compound data generator 1202A reads B7 into line buffer 1602, and, in a ninth step 1818, reads B6 into line buffer 1604. Next, in a tenth step 1820, OR gate 1704 logically combines B7 and B6 to generate EB2. Method 1800 then proceeds to sixth step 1812, where multiplexer 1718 outputs EB2 by coupling second input terminal set 1722 with data output bus 924, afterwhich method 1800 ends.

If, in seventh step 1814, output controller 1214 determines that EB2 is not to be generated, then in an eleventh step 1822, output controller 1214 determines whether the third equally-weighted bit (EB3) is to be generated. If EB3 is to be generated, then in a twelfth step 1824 compound data generator 1202A reads B7 into line buffer 1602, and in a thirteenth step 1826 reads B6 into line buffer 1604. Next, in a fourteenth step 1828, compound data generator 1202A reads B5. Then, in a fifteenth step 1830, OR gate 1706 and AND gate 1710 logically combine B7, B6, and B5 to generate EB3, and method 1800 proceeds to sixth step 1812, where multiplexer 1718 outputs EB3 by coupling third input terminal set 1724 with data output bus 924, afterwhich method 1800 ends.

If, in eleventh step 1822, output controller 1214 determines that EB3 is not to be generated, then in a sixteenth step 1832, output controller 1214 determines whether the fourth equally-weighted bit (EB4) is to be generated. If EB4 is to be generated, then in a seventeenth step 1834, compound data generator 1202A reads B7 into line buffer 1602, and in an eighteenth step 1836 logic array 1606 sets EB4 equal to B7 (fourth set of input terminals 1726 coupled to data lines 1610). Next, method 1800 proceeds to sixth step 1812, where multiplexer 1718 outputs EB4 by coupling fourth input terminal set 1726 with data output bus 924, afterwhich method 1800 ends.

If in sixteenth step 1832, output controller 1214 determines that EB4 is not to be generated, then in a nineteenth step 1838, output controller 1214 determines whether the fifth equally-weighted bit (EB5) is to be generated. If EB5 is to be generated, then in a twentieth step 1840 compound data generator 1202A reads B7 into line buffer 1602, and in a twenty-first step 1842 reads B6 into line buffer 1604. Next, in a twenty-second step 1844, compound data generator 1202A reads B5. Then, in a twenty-third step 1846, OR gate 1708 and AND gate 1712 logically combine B7, B6, and B5 to generate EB5, and method 1800 proceeds to sixth step 1812, where multiplexer 1718 outputs EB5 by coupling fifth input terminal set 1728 with data output bus 924, afterwhich method 1800 ends.

If, in nineteenth step 1838, output controller 1214 determines that EBS is not to be generated, then in a twenty-fourth step 1848, output controller 1214 determines whether the sixth equally-weighted bit (EB6) is to be generated. If EB6 is to be generated, then in a twenty-fifth step 1850 compound data generator 1202A reads B7 into line buffer 1602, and, in a twenty-sixth step 1852, reads B6 into line buffer 1604. Next, in a twenty-seventh step 1854, AND gate 1714 logically combines B7 and B6 to generate EB6. Method 1800 then proceeds to sixth step 1812, where multiplexer 1718 outputs EB6 by coupling sixth input terminal set 1730 with data output bus 924, afterwhich method 1800 ends.

If in twenty-fourth step 1848, output controller 1214 determines that EB6 is not to be generated, then in a twenty-eighth step 1856, output controller 1214 determines whether the seventh equally-weighted bit (EB7) is to be generated. If EB7 is to be generated, then in a twenty-ninth step 1858 compound data generator 1202A reads B7 into line buffer 1602, and in a thirtieth step 1860 reads B6 into line buffer 1604. Next, in a thirty-first step 1862, compound data generator 1202A reads B5. Then, in a thirty-second step 1864, AND gate 1716 logically combine B7, B6, and B5 to generate EB7, and method 1800 proceeds to sixth step 1812, where multiplexer 1718 outputs EB7 by coupling seventh input terminal set 1732 with data output bus 924, afterwhich method 1800 ends. If, in twenty-eighth step 1856, output controller determines that EB7 is not to be generated, then method 1800 returns to first step 1802.

Figure 19:
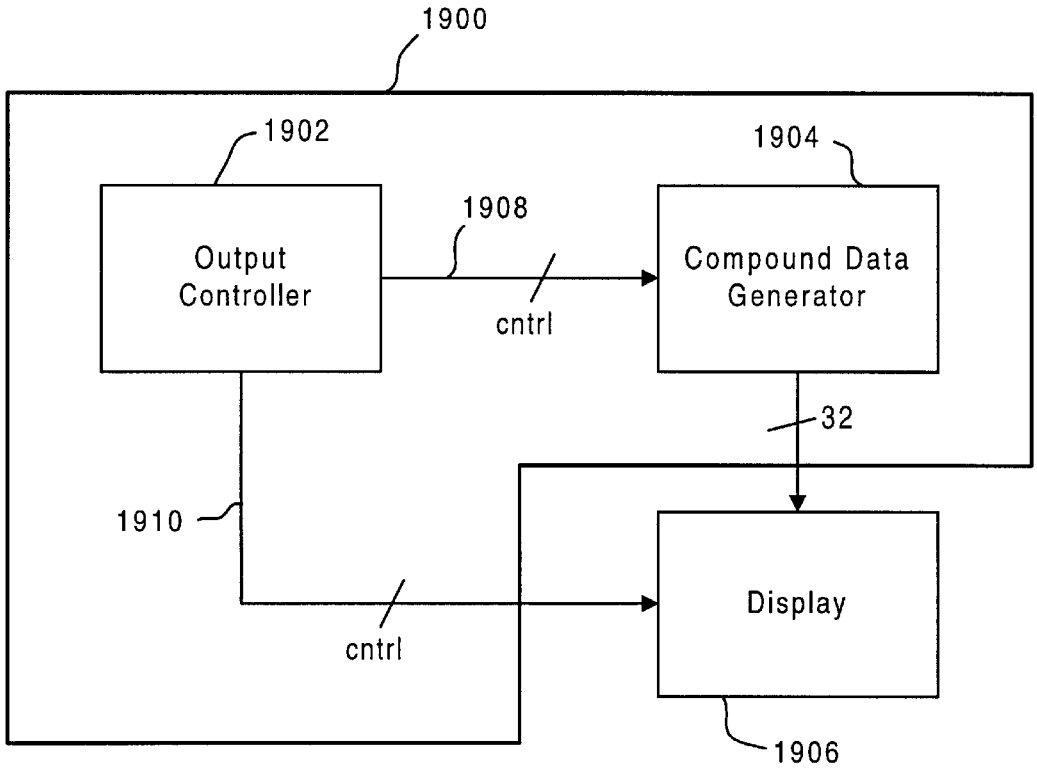
FIG. 19 is a block diagram showing an alternate display driver circuit in accordance with the present invention.

FIG. 19 is a block diagram of an alternate display driver circuit 1900 in accordance with the present invention. Display driver circuit 1900 includes an output controller 1902 and a compound data generator 1904. In contrast to compound data generator 902 of FIG. 9, which converts binary-weighted data words into compound data words, compound data generator 1904 is pre-loaded with the compound data words necessary to generate a desired display. Output controller 1902 provides control signals to compound data generator 1904 and a display 1906, via output control bus 1908 and display control bus 1910, respectively, to coordinate the transfer of data from compound data generator 1904 to display 1906, substantially as described above with respect to output controller 914.

Because there is no need to convert incoming binary-weighted data words into compound data words, display driver circuit 1900 is less complex than display driver circuit 900, and is useful in applications where the image to be displayed is stored in advance, for example a sign which repeatedly displays an advertisement.

Figure 20:
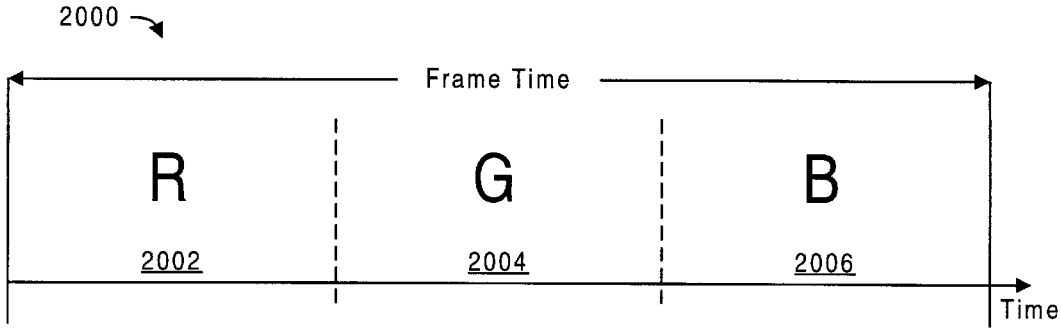
FIG. 20 Prior Art
FIG. 20 shows one frame of field-sequential data according to a prior art driving scheme.

The present invention is also particularly well suited for use in systems employing known field-sequential driving schemes, such as is shown in FIG. 20. In a field-sequential driving scheme, data words corresponding to intensity levels for particular colors are sequentially written to a single display. For example, FIG. 20 shows one frame 2000 of field-sequential data. During a first third 2002 of frame 2000 red data is written to the display (not shown), during a second third 2004 green data is written to the display, and during the last third of the frame 2006 blue data is written to the display. System optics (not shown) are coordinated with the writing of the data, so that the display is sequentially illuminated with red, green, and blue light, while the red, green, and blue data, respectively, are asserted on the display.

Figure 21:
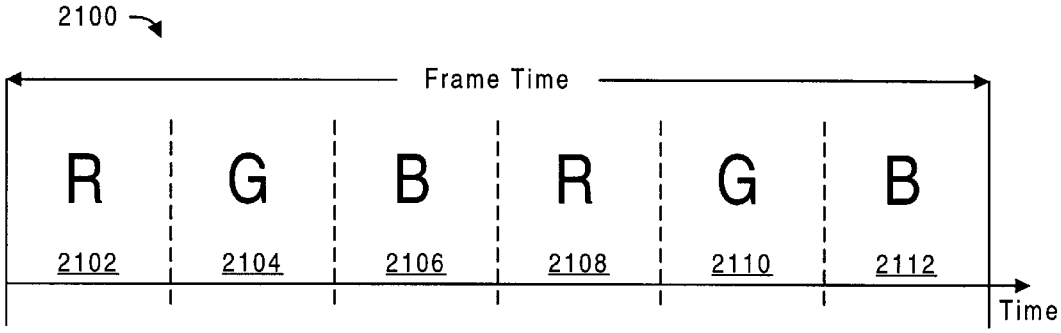
FIG. 21 Prior Art
FIG. 21 shows one frame of field-sequential data according to another prior art driving scheme.

One drawback of the field-sequential color scheme shown in FIG. 20, however, is that visible artifacts may be introduced into the displayed image. FIG. 21 shows one frame 2100 of a known alternate field-sequential driving scheme which reduces such artifacts. According to this alternate driving scheme, frame 2100 is divided into smaller intervals (e.g., sixths) and the data associated with each color is written to the display twice. The red data is written to the display during a first interval 2102, the green data is written to the display during a second interval 2104, and the blue data is written during a third interval 2106. Then, the same red data is written to the display during a fourth interval 2108, the same green data is written during a fifth interval 2110, and the same blue data is written during a sixth interval 2112.

According to the present invention, the field-sequential driving scheme of FIG. 21 is modified to further reduce the maximum data phase difference between adjacent pixel electrodes. As indicated above, increasing the number of bits in a compound data word reduces the maximum data phase difference between adjacent gray scale values. The present invention takes advantage of the double data write in each frame by using compound data words with an increased number of bits, by writing a first portion of the compound data words (some of the bits) during the first data write for a particular color, and then writing a second portion of the compound data words (the rest of the bits) during the second data write.

Figure 22:
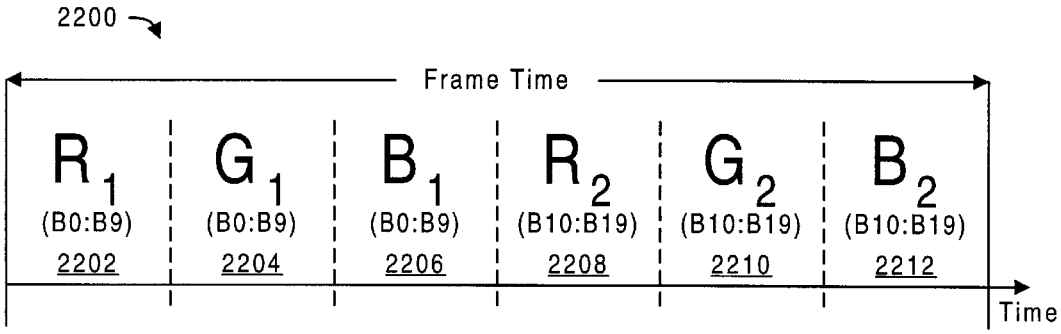
FIG. 22 shows one frame of field-sequential data according to a driving scheme in accordance with the present invention.

FIG. 22 shows one frame 2200 of field-sequential data, in accordance with one of many possible implementations of the present invention. In frame 2200, three 20-bit compound data words are asserted on a pixel electrode, each compound data word having a value corresponding to an intensity level of red, green, and blue light, respectively. During a first sixth 2202 of frame 2200, the first ten bits (B0–B9) of the red compound data word are written to the display pixel. During a second sixth 2204 and a third sixth 2206 of frame 2200, the first ten bits (B0–B9) of the green compound data word and the blue compound data word, respectively, are asserted on the display pixel. Next, during a fourth sixth 2208 of frame 2200, the last ten bits (B10–B19) of the red compound data word are asserted on the display pixel. Finally, during a fifth sixth 2210 and a sixth 2212 of frame 2200, the last ten bits (B10–B19) of the green compound data word and the blue compound data word, respectively, are asserted on the display pixel.

By writing two portions of a single compound data word, instead of writing the same data word twice, the number of bits in the compound data words can be doubled, facilitating a substantial reduction in the maximum phase difference between adjacent gray scale values. Those skilled in the art will recognize, however, that the present invention is not limited to using compound data words having a particular number of bits, to dividing the compound data words into a particular number of portions, or to any particular ordering of the bits within the portions of the compound data words. Rather, each of these factors may be varied to optimize the overall performance of a particular system.

For example, in order not to reintroduce the visible artifacts eliminated from the field-sequential driving scheme by writing each data word twice, it is desirable to keep the intensity level of each asserted portion of a compound data word as close as possible. By way of example, and for the purpose of explaining the following drawings, assume that each bit of a twenty-bit compound data word is numbered as follows. Bits B0–B7 are binary weighted bits, with bit B0 being the least significant bit, and B7 being the most significant bit. Bits B8–B19 are equally weighted bits.

Figure 23:
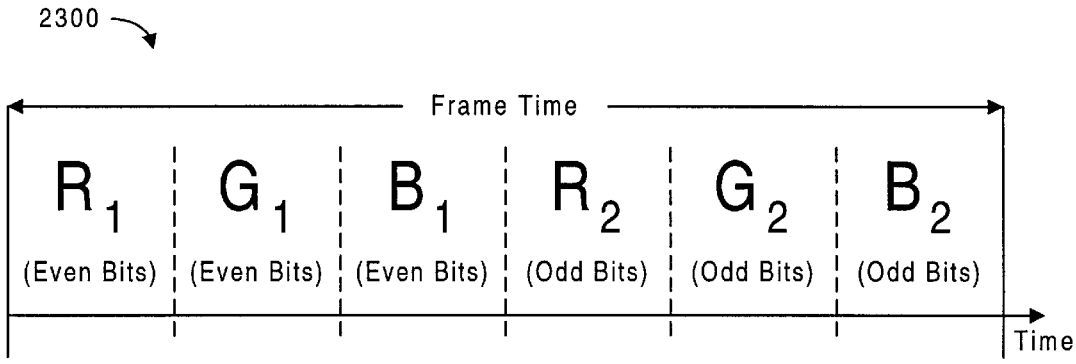
FIG. 23 shows one frame of field-sequential data according to another driving scheme in accordance with the present invention.

FIG. 23 shows one frame 2300 of a field sequential driving scheme, wherein each compound data word is divided into two portions. The first portion includes the even numbered bits, and the second portion includes the odd numbered bits. Recall from the discussion of FIG. 8, that as gray scale values increase, the equally weighted bits of the compound data words are uniformly incremented. Thus, for a particular compound data word, all of the equally-weighted data bits having a lower number than the highest "on" bit will be "on", and all of the data bits having a higher number than the highest "on" bit will be "off". For example, if the highest "on" bit in a particular 20 bit compound data word of our example is bit B14, then bits B8–B13 will also be "on" and bits B15–B19 will be "off". Grouping the even bits in one portion (e.g., the first portion) and the odd bits in the other portion insures that the portions can vary by no more than one equally-weighted bit and the binary weighted bits.

Figure 24:
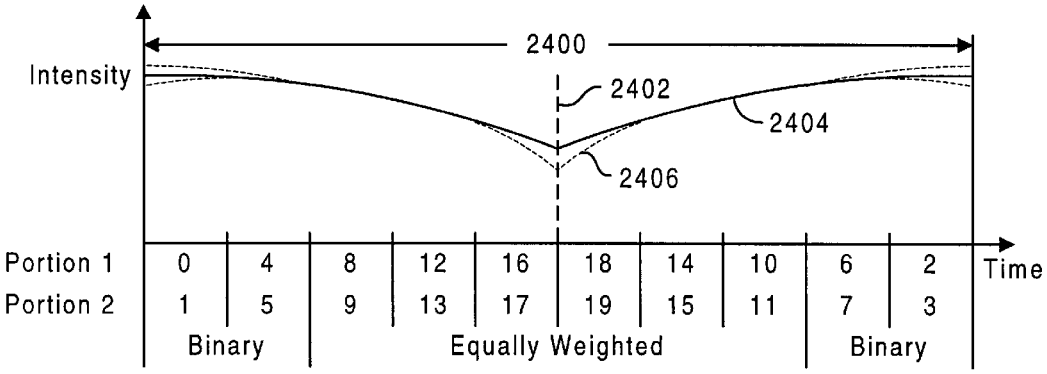
FIG. 24 is an intensity versus time curve for a particular field-sequential driving scheme in accordance with the present invention.

FIG. 24 is an intensity versus time curve over a time interval 2400, illustrating a further refinement to the above described bit grouping scheme, wherein the bits in each portion of the compound data words are arranged such that the shape of the intensity curve for each portion is similar. In particular, the bits are arranged by bit number, in alternating fashion, about a point near the center 2402 of the time interval 2400, with the larger numbered bits positioned near the center, and the smaller numbered bits near the ends. It should be understood that the term "center", when used with respect to portions of compound data words or interval 2400 refers to the position of the median bit number, and that the bits need not necessarily be arranged about the precise time center of interval 2400.

FIG. 24 shows how such an arrangement results in similar curve shapes for the first and second portions of the compound data word. Solid curve 2404 represents the intensity curve for Portion 1 of some particular compound data word. If the highest equally weighted "on" bit in the example compound data word is an odd numbered bit, then Portion 1 and Portion 2 will have the same number of equally weighted "on" bits, and, therefore, similar intensity curves for the equally weighted data bits. If, however, the highest equally weighted "on" bit in the example compound data word is an even numbered bit, then Portion 1 will have one more equally weighted "on" bit than Portion 2, and the intensity curve for Portion 2 will drop slightly below curve 2404 by an amount corresponding to one equally-weighted bit, as shown by dashed curve 2406.

Because the compound data word of this example contained a number of bits equally divisible by 4 (i.e., 20), the arrangement of equally-weighted bits and binary-weighted bits about the center 2402 of interval 2400 is symmetrical. This, however, is not an essential element of the present invention. Rather, the arrangement of data bits with respect to the center of frame modified to accommodate compound data words having different numbers of equally-weighted bits and/or binary weighted bits. For example, if there are an odd number of equally-weighted bits in each portion, then the highest numbered bit can be disposed in the center of the interval instead of on one side of the center or the other. If there is an odd number of binary weighted data bits in each portion of the compound data word, then there would be one more binary-weighted bit disposed at one end of the portion than at the other.

Figure 25:
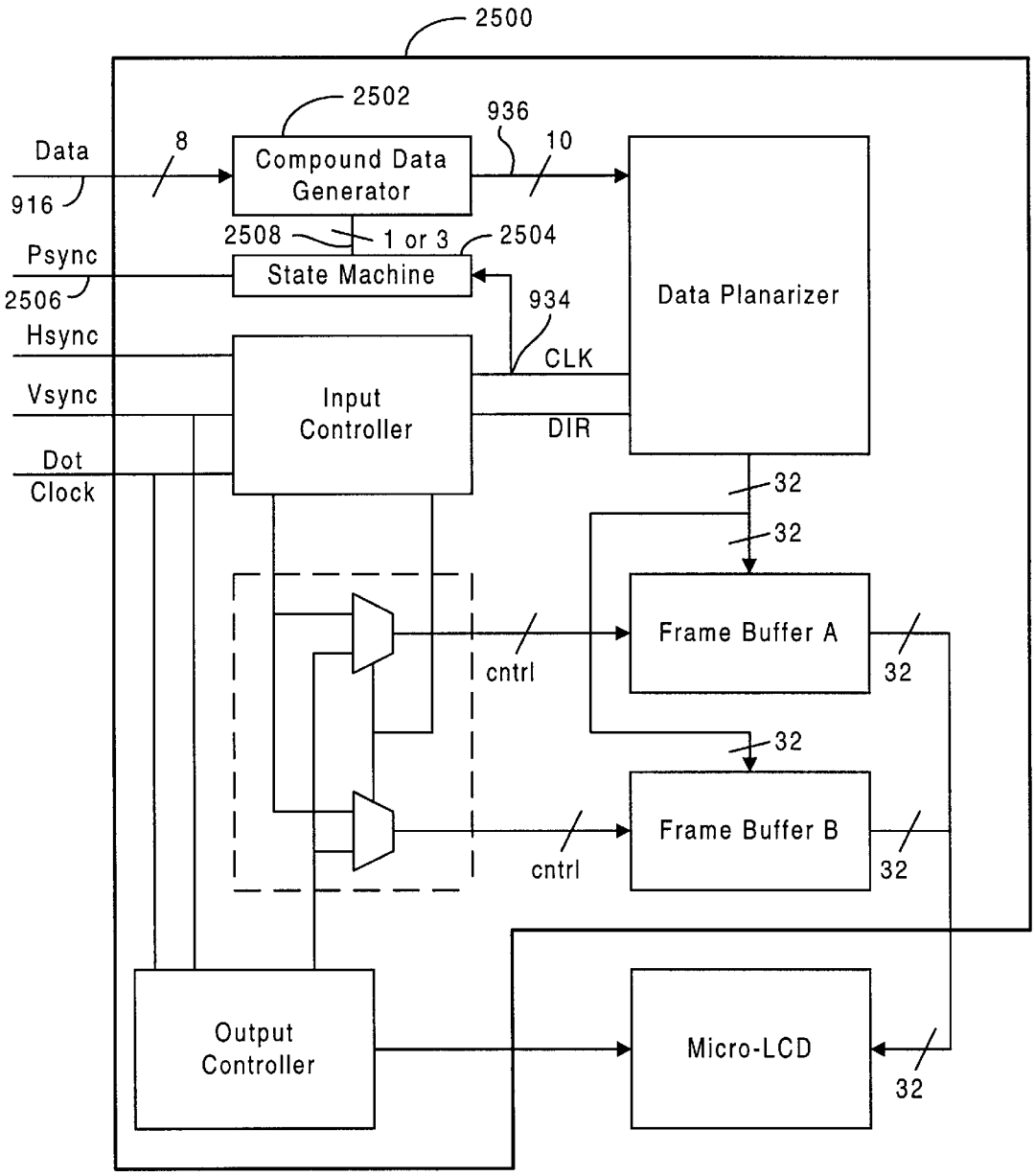
FIG. 25 is a block diagram showing a display driver circuit for implementing the various field-sequential driving schemes of the present invention.

FIG. 25 is a block diagram of a display driver circuit 2500 for carrying out the above described field-sequential display driving scheme. Display driver circuit 2500 is similar to display driver circuit 900 described above, but includes an alternate compound data generator 2502 and a state machine 2504. Compound data generator 2502 receives data words of a first type (e.g., binary weighted) via data input bus 916, converts the received data words to compound data words, and asserts the compound data words on compound data bus 936. In this particular embodiment, compound data generator 2502 converts each 8-bit binary weighted data word into a 20-bit compound data word, in two 10 bit portions. The 8-bit binary weighted data word is converted to either the first portion or the second portion of the compound data word depending on a control signal (e.g., high or low) asserted on one of the terminals of control terminal set 2508.

The number of lines in control terminal set 2508 depends on the complexity of the data conversion scheme. If the compound data words are generated in two portions, and the data conversion is the same regardless of color, then one bit (i.e., one line in control terminal set 2508) is sufficient to indicate which portion of the compound data word is generated. If different data conversion schemes are employed for each color, then 2 additional bits are necessary to indicate which color scheme is used to generate the data. If the compound data words are generated in a greater number of portions or according to a greater number of color conversion schemes, then additional bits can be added to control terminal set 2508 to communicate this information between state machine 2504 and compound data generator 2502.

State machine 2504 receives a Psync signal via line 2506, indicating a color change in the incoming data, and the CLK signal via line 934, indicating that data is being clocked into display driver 2500. State machine 2504 generates control signals responsive to the Psync and CLK signals, and asserts the control signals on a control terminal set 2508 of compound data generator 2502. In a particularly simple embodiment, state machine 2504 is a counter, which counts the Psync and CLK signals and increments the control signals on control terminal set 2508 accordingly.

Figure 26:
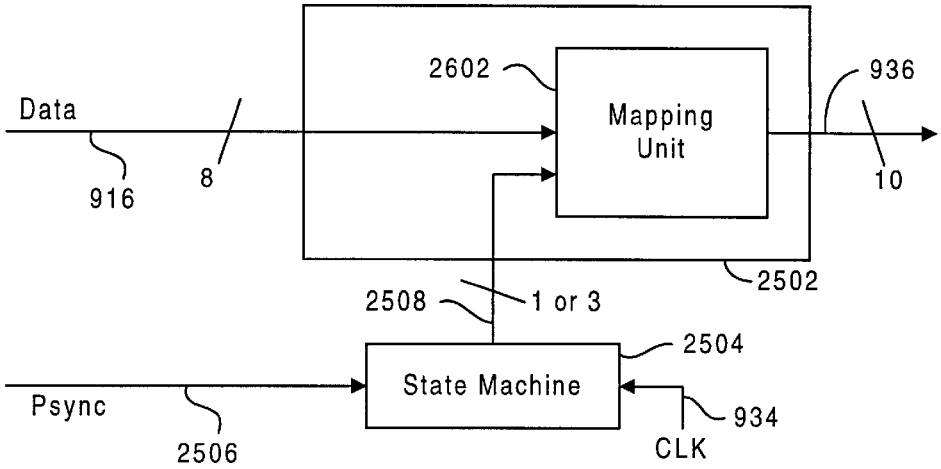
FIG. 26 is a block diagram showing a compound data generator of FIG. 25 in greater detail.

FIG. 26 is a block diagram showing a particularly simple embodiment of compound data generator 2502 in greater detail, to include a mapping unit 2602. Mapping unit 2602 is a memory device which retrieves a particular 10-bit portion of a compound data word from a location indicated by the 8-bit binary weighted data word received on data input bus 916 and the control signals received on control terminal set 2508, and asserts the retrieved portion on compound data bus 936. In order to store three different color schemes for converting 8-bit binary weighted data words to 20-bit compound data words (in two 10-bit portions) mapping unit 2602 should have a minimum of 1,536 addressable 10-bit storage locations.

Figure 27:
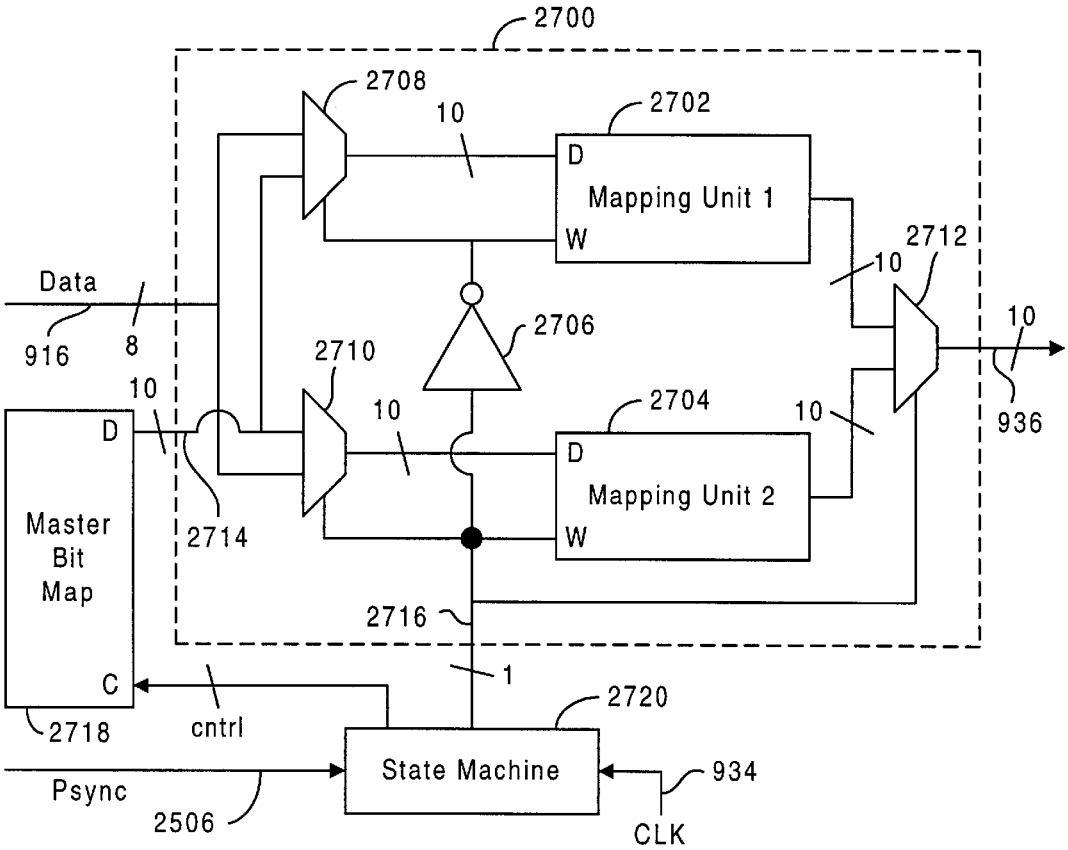
FIG. 27 is a block diagram showing an alternate compound data generator.

FIG. 27 is a block diagram of an alternate compound data generator 2700, which requires less on-chip memory and facilitates off-chip storage of the master bit-mapping scheme, adding an additional degree of flexibility to display driver circuit 2500. Compound data generator 2700 includes a first mapping unit 2702, a second mapping unit 2704, an inverter 2706, first multiplexer 2708, second multiplexer 2710, third multiplexer 2712, a bit map input bus 2714, and a control terminal 2716. First mapping unit 2702 and second mapping unit 2704 each have sufficient memory to store a portion of the master bit map corresponding to a particular color and a particular portion of a generated compound data word. The input terminal of inverter 2706 is coupled to control terminal 2716, and the output terminal of inverter 2706 is coupled to a Write control terminal of first mapping unit 2702. The Write control terminal of second mapping unit 2704 is coupled to control terminal 2716. First multiplexer 2708 selectively couples data input bus 916 and bit map input bus 2714 with the data terminal set of first mapping unit 2702, and is controlled by the output of inverter 2706. Second multiplexer 2710 selectively couples data input bus 916 and bit map input bus 2714 with the data terminal set of second mapping unit 2704, and is controlled by signals on control terminal 2716. Third multiplexer 2712 selectively couples the compound data outputs of first mapping unit 2702 and second mapping unit 2704 with compound data bus 936, and is controlled by signals on control terminal 2716.

Responsive to a first control signal being asserted on their Write control terminals (W), first mapping unit 2702 and second mapping unit 2704 load the data (i.e., a particular bit mapping scheme) on their respective data input terminal sets (D). Responsive to a second control signal being asserted on their Write control terminals (W), first mapping unit 2702 and second mapping unit 2704 convert the data (e.g., a binary weighted data word) on their respective data input terminal sets (D) into a portion of a compound data word according to the loaded bit mapping scheme, and assert the compound data word portion on their respective outputs. Because the write terminal (W) of second mapping unit 2704 and the write terminal (W) of first mapping unit 2702 are coupled via inverter 2706, second mapping unit 2704 loads a particular bit mapping scheme while first mapping unit 2702 is generates compound data word portions, and vice versa. Because multiplexers 2708 and 2710 are responsive to the same control signals (and inverted control signals) as first mapping unit 2702 and second mapping unit 2704, respectively, multiplexers 2708 and 2710 couple the data input terminal sets of mapping units 2702 and 2704 to bit map input bus 2714 when mapping units 2702 and 2704 are loading bit mapping schemes, and couple the data input terminal sets of mapping units 2702 and 2704 to data input bus 916 when mapping units 2702 and 2704 are generating compound data word portions.

Note that mapping units 2702 and 2704 each have a 10-bit data input terminal set, whereas data input bus 916 has only 8 bits. This is because the bit mapping schemes are loaded 10 bits at a time, but the incoming binary weighted data is 8-bit data. This does not present a problem, however, because when first mapping unit 2702 or second mapping unit 2704 is generating compound data from incoming binary weighted data, two data input terminals are simply unused.

Those skilled in the art will recognize that details such as the configuration of input terminals on storage devices vary from device to device. For example, some devices use the same terminals to receive data and addresses, whereas other devices provide separate terminal sets for data and addresses. Such details are not considered to be essential to the practice of the present invention.

The master bit mapping scheme (i.e., the compound data conversion scheme) is stored in an off-chip storage device 2718, and includes a plurality of predetermined mapping schemes, each corresponding to a particular color of display light and a particular portion (e.g., first, second, etc.) of the compound data words. Responsive to control signals received via its control terminal set (C), storage device 2718 asserts particular ones of the predetermined mapping schemes, 10 bits at a time, on bit map input bus 2714, for loading into one of first mapping unit 2702 or second mapping unit 2704, depending on the control signal being asserted on control terminal 2716 of compound data generator 2700.

The control signals used by compound data generator 2700 are generated by an alternate state machine 2720, responsive to Psync signals received via line 2506 and CLK signals received via line 934. The control signal asserted by state machine 2720 on control terminal 2716 is simply a single bit high or low signal, which is toggled each time the color associated with the stream of incoming data changes.

The control signals provided by state machine 2720 to storage device 2718 depend on the particular storage device used. Generally the control signals will include a stream of addresses where a particular one of the predetermined mapping schemes is stored in storage device 2718, and a signal to cause storage device 2718 to assert the contents of the addressed locations onto bit map input bus 2714. The configuration of a state machine to provide such control signals is generally available from the manufacturer of the particular storage device employed, and in any event is well within the ability of one of ordinary skill in the art.

Figure 28:
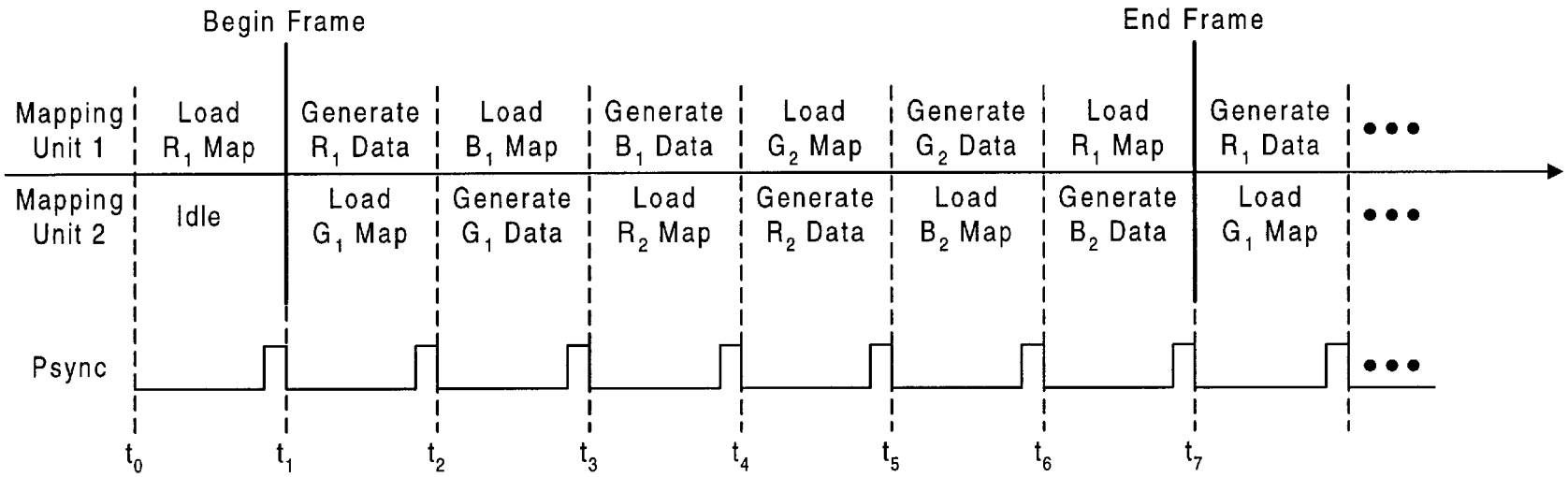
FIG. 28 is a timing diagram showing an implementation of the compound data generator of FIG. 27.

FIG. 28 is a timing diagram illustrating one method for implementing display driver circuit 2700. The method begins at a time to, when state machine 2720 asserts a first control signal on control terminal 2716 of compound data generator 2700, causing first multiplexer 2708 to couple the data terminal set (D) of first mapping unit 2702 with bit map input bus 2714, and placing first mapping unit 2702 in load mode. From time $t_0$ to a time $t_1$, first mapping unit 2702 loads a particular predetermined mapping scheme for generating a first portion of a red compound data word from storage device 2718. Then, at time $t_1$, state machine 2720 asserts a second control signal on control terminal 2716, causing first multiplexer 2708 to couple the data terminal set (D) of first mapping unit 2702 with data input bus 916, placing first mapping unit 2702 in conversion mode, causing second multiplexer 2710 to couple the data terminal set (D) of second mapping unit 2704 with bit map input bus 2714, placing second mapping unit 2702 in load mode, and causing third multiplexer 2712 to couple the output of first mapping unit 2702 with compound data bus 936. During the time period from $t_1$ to $t_2$, first mapping unit 2702 converts the incoming red binary weighted data words to the first portions (10 bits) of associated compound data words according to the loaded red mapping scheme. During this same time period, second mapping unit 2704 loads a particular predetermined mapping scheme for generating first portions of compound data words for green data from storage device 2718. At time $t_2$, state machine reasserts the first control signal on control terminal 2716, placing first mapping unit 2702 in load mode, placing second mapping unit 2704 in conversion mode, and causing third multiplexer 2712 to couple the output of second mapping unit 2704 with compound data bus 936. During the time period from $t_2$ to $t_3$, first mapping unit 2702 loads a predetermined mapping scheme for generating first portions of compound data words for blue data, while second mapping unit 2704 converts the incoming green binary weighted data to green, first portion compound data.

This alternating load/convert sequence continues as follows. From time $t_3$ to time $t_4$, first mapping unit 2702 converts the incoming blue binary weighted data to blue, first portion compound data, while second mapping unit 2704 loads a predetermined mapping scheme for generating second portions of compound data words for red data. During the time period from $t_4$ to $t_5$, first mapping unit 2702 loads a predetermined mapping scheme for generating second portions of compound data words for green data, while second mapping unit 2704 converts the incoming red binary weighted data to red, first portion compound data. During the time period from $t_5$ to $t_6$, first mapping unit 2702 converts the incoming green binary weighted data to green, second portion compound data, while second mapping unit 2704 loads a predetermined mapping scheme for generating second portions of compound data words for blue data. During the time period from $t_6$ to $t_7$, first mapping unit 2702 loads a predetermined mapping scheme for generating first portions of compound data words for red data (in preparation for the next frame of data), while second mapping unit 2704 converts the incoming blue binary weighted data to blue, first portion compound data. The above described sequence repeats for each successive frame of data.

Note, however, that during one frame the same binary weighted data is processed through compound data generator 2700 twice, first to generate the first portions of the compound data words, and then again to generate the second portions of the compound data words. The necessity for loading the binary weighted data a second time may be eliminated, thus reducing the interface bandwidth requirement of display driver circuit 2500 by providing a buffer for storing the binary weighted data or for storing at least a portion of the generated compound data. The reduction in the interface bandwidth requirement comes, however, at the expense of providing the additional memory.

Figure 29:
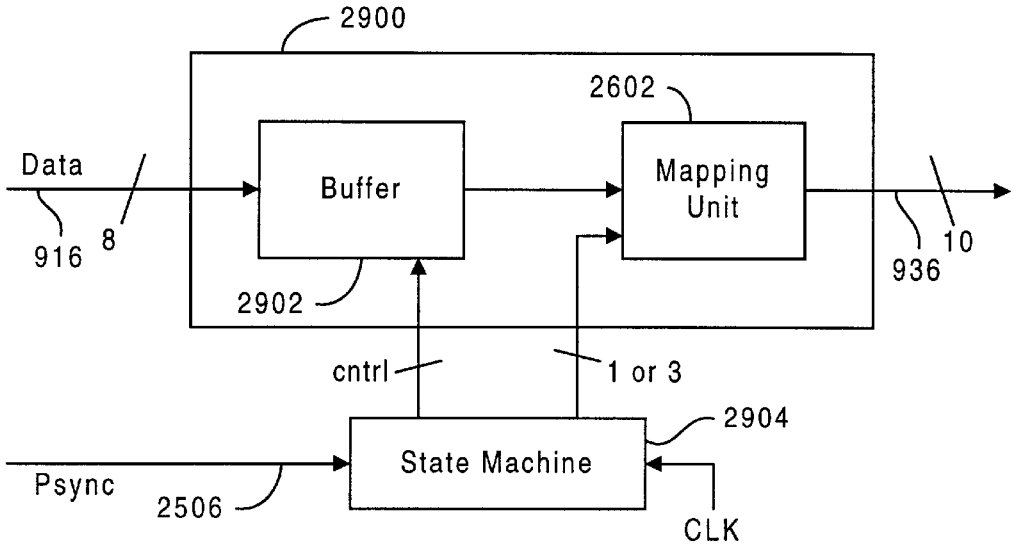
FIG. 29 is a block diagram showing another alternate compound data generator.

FIG. 29 is a block diagram showing an alternate compound data generator 2900 which provides storage for the incoming binary weighted data words. Compound data generator 2900 includes a buffer 2902 disposed between data input bus 916 and mapping unit 2602. Buffer 2902 stores the incoming binary-weighted data words as they are passed through to mapping unit 2602 for the generation of the first portions of the compound data words. Then, buffer 2902 provides the stored binary weighted data words to mapping unit 2602 a second time for the generation of the second portions of the compound data words. Alternate state machine 2904 provides control signals (e.g., address sequence) to buffer 2902, first to store the incoming data, and then to output the stored data.

For a typical display application, the required capacity of buffer 2902 is substantial. For example, buffer 2902 must be able to store one binary weighted data word per display pixel per color. For an 8-bit, three color data scheme and a 768×1024 pixel display, buffer 2902 would need to have a capacity of approximately 2.36 Mbytes.

Figure 30:
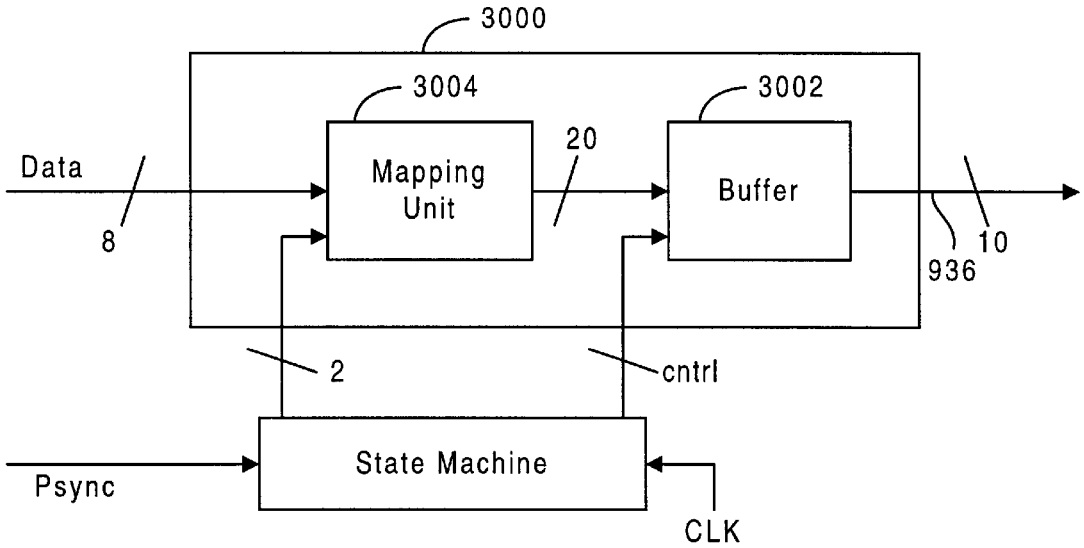
FIG. 30 is a block diagram showing another alternate compound data generator.

FIG. 30 is a block diagram showing an alternate compound data generator 3000, including a buffer 3002 interposed between an alternate mapping unit 3004 and compound data bus 936. Alternate mapping unit 3004 generates an entire compound data word (e.g., 20 bits) responsive to receipt of a data word of a first type (e.g., 8-bit binary weighted) and a control signal indicating a particular mapping scheme (e.g., color), and provides the compound data word to buffer 3002. Buffer 3002 passes a first portion of each compound data word to compound data bus 936, and stores a second portion of each compound data word. Once a frame of first portions of compound data words are passed, buffer 3002 sequentially asserts the stored second portions of the compound data words on compound data bus 936.

As described above with respect to FIG. 12, compound data may be generated from binary-weighted data, after the binary-weighted data is planarized. This is also true for the field-sequential compound data scheme of the present invention.

Figure 31:
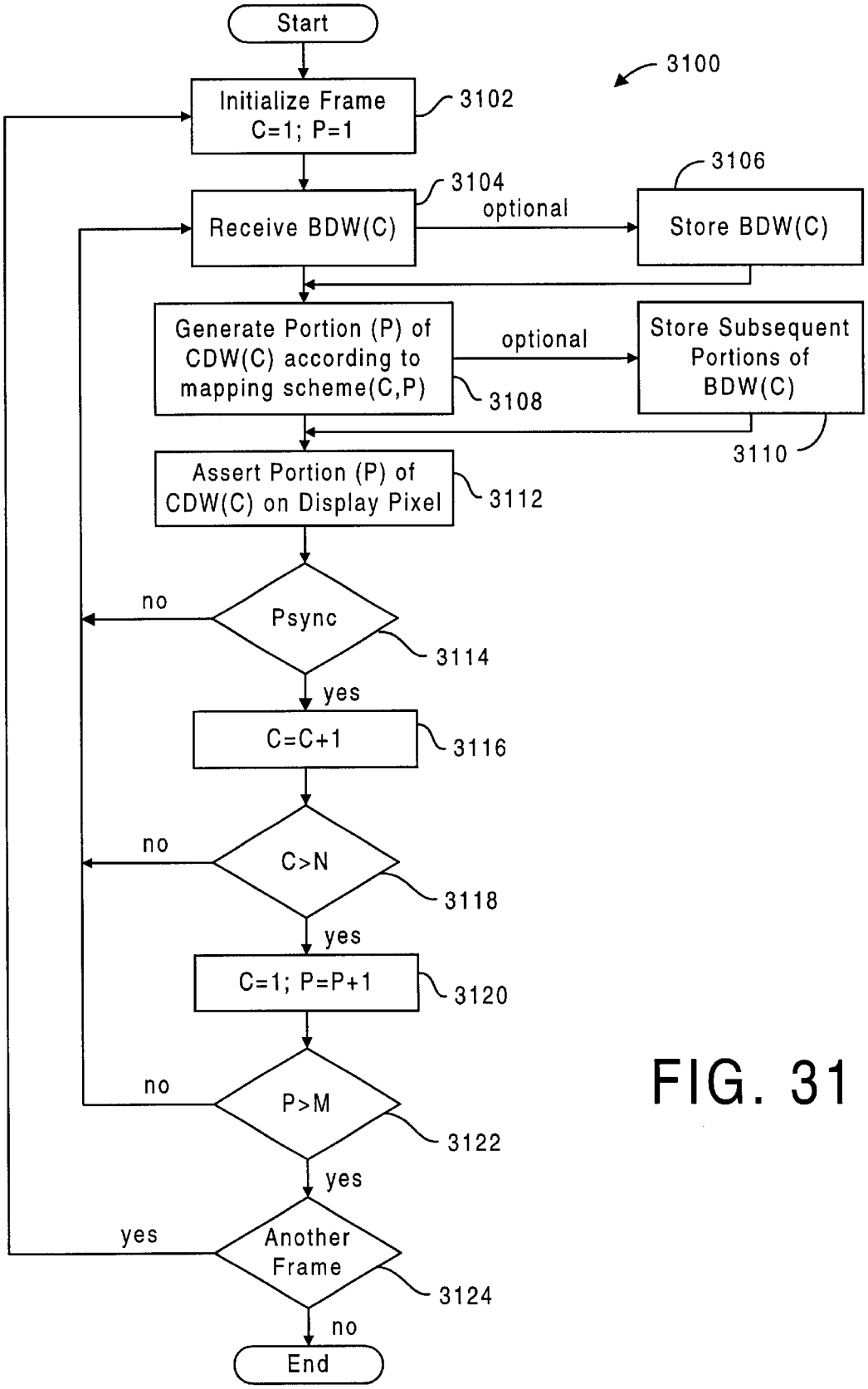
FIG. 31 is a flow chart detailing a particular method for asserting compound data words on a pixel electrode according to the present invention.

FIG. 31 is a flow chart summarizing a method of asserting at least two compound data words (e.g., red and green) on a display pixel according to the present invention. In a first step 3102, the display driver circuit initializes two variables C and P, setting both equal to 1, in preparation of receiving a frame of data. The variable C represents the display color associated with the incoming video data, and P represents the portion (e.g., first portion, second portion, etc.) of the compound data word to be generated. In a second step 3104, the compound data generator receives a data word of a first type (e.g., a binary weighted data word), and in an optional third step 3106, stores the binary weighted data word for subsequent retrieval. If the binary weighted data word is stored in optional third step 3106, then subsequent steps of receiving the same data word in second step 3104 may be accomplished by retrieving the data word from storage.

Next, in a fourth step 3108, the compound data generator generates at least a portion of a compound data word from the received binary weighted data word according to a particular mapping scheme indicated by the variables C and P, which in the first instance (C=1 and P=1) indicate that a first portion of a compound data word associated with a first color is to be generated.

Optionally, the compound data generator generates the entire compound data word when P=1, and then in an optional fifth step 3110 stores subsequent portions of the generated compound data word. Then, generating subsequent portions (i.e., P>1) of compound data words is accomplished in fourth step 3108 by retrieving the appropriate portion from storage.

After the portion of a compound data word is generated in fourth step 3108, then in a sixth step 3112 the data bits of that portion are asserted on the display pixel. Next, in a seventh step 3114, the display driver circuit determines whether the display color associated with the incoming data stream has changed by, for example, monitoring the Psync signal. If, in seventh step 3114, the display driver circuit determines that the color associated with the data stream has not changed, then method 3100 returns to second step 3104 to receive the next incoming data word. If however, in seventh step 3114, the display driver circuit determines that the color associated with the incoming data stream has changed, then in an eighth step 3116 the variable C is incremented.

Next, in a ninth step 3118, the display driver circuit determines whether the value of the variable C has exceeded a predetermined number of system colors (N). If C is not greater than N, then method 3100 returns to second step 3104 to receive the first data word associated with the next display color. If C is greater than N, then in a tenth step 3120, the display driver circuit reinitializes the variable C (sets C=1) and increments the variable P.

Next, in an eleventh step 3122, the display driver circuit determines whether the value of the variable P exceeds a predetermined number of portions (M) to be generated for each compound data word. If P is not greater than M, then method 3100 returns to second step 3104 to receive the next binary-weighted data word. If P is greater than M, then in a twelfth step 3124, the display driver circuit determines whether there is another frame of incoming data to process. If there is more incoming data, then method 3100 returns to first step 3102 to reinitialize the variables C and P. If there is no further incoming data, then method 3100 ends.

The description of particular embodiments of the present invention is now complete. Many of the described features may be substituted, altered or omitted without departing from the scope of the invention. For example, data of other types (i.e., other than binary-weighted) may be converted to compound data. Additionally, a compound data word may be formed from three or more groups of bits. For example, a compound data word may include a first group of binary-weighted bits, a second group of equally-weighted bits, and a third group of equally-weighted bits having a different significance than the second group of equally-weighted bits. Further, the use of compound data is not limited to liquid crystal displays. Rather, compound data may be beneficially used wherever it is desirable to reduce the phase difference between adjacent data values. As another example, various control signals generated by the components of the display driver circuit (e.g., control signals from state machine 2504) may instead be supplied by the system providing the video data. These and other substitutions, alterations and/or omissions will be apparent to those skilled in the art, particularly in view of the present disclosure.

I claim:

1. A display driver circuit for writing compound data words to a display pixel, said compound data words each including a group of equally weighted bits and a group of unequally weighted bits, said display driver circuit comprising:

an output controller configured to provide display control signals to sequentially assert a first portion of a first one of said compound data words, a first portion of a second one said compound data words, a second portion of said first compound data word, and a second portion of said second compound data word on said display pixel.

2. A display driver circuit according to claim 1, wherein said control signals cause each equally weighted bit to be asserted on said display pixel for a co-equal time period and each unequally weighted bit to be asserted on said display pixel for a differing time period dependent on an associated significance of each said unequally weighted bit.

3. A display driver circuit according to claim 2, further comprising a compound data generator configured to provide said compound data words.

4. A display driver circuit according to claim 3, wherein said compound data generator includes a data input terminal set for receiving data words of a first type, and wherein, said compound data words are generated from said data words of said first type.

5. A display driver circuit according to claim 4, wherein said compound data generator comprises an arithmetic logic unit for operating on said data words of said first type to generate said compound data words.

6. A display driver circuit according to claim 4, wherein said compound data generator comprises a memory device.

7. A display driver circuit according to claim 4, wherein said compound data generator comprises a look-up-table.

8. A display driver circuit according to claim 4, wherein said compound data generator further comprises:

control terminal set for receiving a mapping control signal for indicating one of a plurality of predefined mapping schemes; and a mapping unit for mapping said data words of said first type to at least a portion of said compound data words according to said indicated one of said predefined mapping schemes.

9. A display driver circuit according to claim 8, wherein:

one of said predefined mapping schemes maps said data words of said first type to said first portions of said compound data words; and another of said predefined mapping schemes maps said data words of said first type to said second portions of said compound data words.

10. A display driver circuit according to claim 8, wherein:

one of said predefined mapping schemes maps said data words of said first type to said compound data words having values appropriate for a first display color; and another of said predefined mapping schemes maps said data words of said first type to said compound data words having values appropriate for a second display color.

11. A display driver circuit according to claim 8, further comprising a control signal generator for receiving video control signals, and generating said mapping control signals responsive to said video control signals.

12. A display driver circuit according to claim 8, further comprising a storage device, including a control terminal set and a data output terminal set, said storage device being configured to store said plurality of predefined mapping schemes, and to provide particular ones of said predefined mapping schemes on said data output terminal set responsive to receipt of associated control signals on said control terminal set.

13. A display driver circuit according to claim 12, wherein:

said mapping unit includes a control terminal set and a data input terminal set, said data input terminal set being selectively coupled to said data input terminal set of said compound data generator and said data output terminal set of said storage device; and responsive to a first control signal on its control terminal set said mapping unit loads one of said predetermined mapping schemes from said storage device; and responsive to a second control signal on its control terminal set said mapping unit maps said data words of said first type to at least a portion of said compound data words according to said loaded predefined mapping scheme.

14. A display driver circuit according to claim 13, wherein:

said compound data generator further comprises a second mapping unit including a control terminal set and a data input terminal set, said data input terminal set being selectively coupled to said data input terminal set of said compound data generator and said data output terminal set of said storage device; and responsive to a first control signal on its control terminal set said second mapping unit loads another one of said predetermined mapping schemes from said storage device; and responsive to a second control signal on its control terminal set said mapping unit maps said data words of said first type to at least a portion of said compound data words according to said loaded predefined mapping scheme.

15. A display driver circuit according to claim 8, wherein said compound data generator further comprises a buffer coupled to said data input terminal set for storing said data words of said first type and for subsequently providing said data words of said first type to said mapping unit for the generation of a second portion of said compound data words.

16. A display driver circuit according to claim 4, further comprising:

a mapping unit coupled to receive said data words of said first type and operative to map said data words of said first type to compound data words and to output said compound data words; and a buffer coupled to receive at least a portion of each said compound data word from said mapping unit and operative to subsequently output said stored portion of said compound data words.

17. A display driver circuit according to claim 4, wherein said compound data generator further comprises:

a data input terminal set;

a plurality of line buffers, each associated with a particular bit of said data words of said first type, coupled to said input terminal set, for receiving and storing said associated bits of said data words of said first type; and a logic array, coupled to receive said stored data bits from said line buffers, and operative to logically combine said received bits to generate said equally weighted bits of said compound data words.

18. A display driver circuit according to claim 4, wherein said compound data generator further comprises:

a second data input terminal set for receiving data maps;

a control terminal set for receiving a control signal;

an output terminal set for providing said compound data words;

a first mapping unit including a data input terminal set selectively coupled to said data input terminal set of said compound data generator and said second data input terminal set of said compound data generator, a control terminal coupled to said control terminal set of said compound data generator, and a data output terminal set coupled to said output terminal set of said compound data generator.

19. A display driver circuit according to claim 18, wherein said compound data generator further comprises a second mapping unit including a data input terminal set selectively coupled to said data input terminal set of said compound data generator and said second data input terminal set of said compound data generator, a control terminal coupled to said control terminal of said compound data generator, and a data output terminal set coupled to said output terminal set of said compound data generator.

20. A display driver circuit according to claim 18, wherein said compound data generator further comprises an inverter coupled between said control terminal of said first mapping unit and said control terminal of said second mapping unit.

21. A method for asserting at least two compound data words on a display pixel, said compound data words each including a group of equally weighted bits and a group of unequally weighted bits, said method comprising the steps of:

asserting a first portion of a first one of said compound data words on said display pixel;

asserting a first portion of a second one of said compound data words on said display pixel;

asserting a second portion of said first compound data word on said display pixel; and asserting a second portion of said second compound data word on said display pixel.

22. A method according to claim 21, further comprising the steps of:

asserting a first portion of a third one of said compound data words on said display pixel following said step of asserting said first portion of said second compound data word on said display pixel; and asserting a second portion of said third compound data word on said display pixel following said step of asserting said second portion of said second compound data word on said display pixel.

23. A method according to claim 22, wherein each compound data word has a value corresponding to the intensity of a particular color of light modulated by said display pixel.

24. A method according to claim 21, further comprising the steps of:

receiving a data word of a first type; and generating said first compound data word from said data word of said first type.

25. A method according to claim 24, wherein said first compound data word is generated from said data word of said first type according to a predetermined mapping scheme.

26. A method according to claim 25, wherein said step of generating said first compound data word comprises using said data word of said first type to retrieve said compound data word from a look-up-table.

27. A method according to claim 24, wherein said step of generating said first compound data word from said data word of said first type comprises storing said second portion of said first compound data word.

28. A method according to claim 24, wherein said step of generating said first compound data word from said data word of said first type comprises:

receiving a control signal; and using said control signal to generate said first compound data word.

29. A method according to claim 28, wherein said control signal indicates a particular one of a plurality of predetermined mapping schemes.

30. A method according to claim 29, wherein said particular predetermined mapping scheme maps said data word of said first type to a compound data word having a value appropriate for a particular display color.

31. A method according to claim 30, wherein:

said first portion of said first compound data word is generated according to one of said predetermined mapping schemes responsive to a first value of said control signal;

said second portion of said first compound data word is generated according to another one of said predetermined mapping schemes responsive to a second value of said control signal.

32. A method according to claim 28, wherein:

said first portion of said first compound data word is generated according to one of said predetermined mapping schemes responsive to a first value of said control signal;

said second portion of said first compound data word is generated according to another one of said predetermined mapping schemes responsive to a second value of said control signal.

33. A method according to claim 28, wherein said step of using said control signal to generate said first compound data word comprises:

using said data word of said first type and said control signal to generate said first portion of said first compound data word;

receiving said data word of said first type again;

receiving a second control signal; and using said data word of said first type and said second control signal to generate said second portion of said first compound data word.

34. A method according to claim 33, wherein:

said step of receiving said data word of said first type comprises storing said data word of said first type; and said step of receiving said data word of said first type again comprises retrieving said data word of said first type from storage.

35. A method according to claim 21, wherein said first portion of said first compound data word includes at least on equally weighted bit and at least one unequally weighted bit.

36. A method according to claim 35, wherein:

said bits of said first compound data word are numbered according to significance;

said odd numbered bits are included in one of said first portion of said first compound data word and said second portion of said first compound data word; and said even numbered bits are included in the other of said first portion of said first compound data word and said second portion of said first compound data word.

37. A method according to claim 35, wherein the bits in at least one of said first portion and said second portion are arranged according to significance, in alternating fashion, about one bit of said one of said first portion and said second portion.

38. A method according to claim 21, wherein the number of bits in said first portion of said first compound data word is within one of the number of bits in said second portion of said first compound data word.

39. A method according to claim 38, wherein the bits of at least one of said first portion of said first compound data word and said second portion of said first compound data word are asserted on said pixel electrode in an order of increasing significance.

40. A method according to claim 38, wherein the bits of at least one of said first portion of said first compound data word and said second portion of said first compound data word are asserted on said pixel electrode in an order of decreasing significance.

* * * * *